US009238910B2

(12) United States Patent
Jensen

(10) Patent No.: US 9,238,910 B2
(45) Date of Patent: Jan. 19, 2016

(54) INTERLOCKING WALL UNIT SYSTEM FOR CONSTRUCTING A WALL ON A PRE-EXISTING STRUCTURAL GRID MATRIX

(76) Inventor: David I. Jensen, Santa Rosa, CA (US)

( * ) Notice: Subject to any disclaimer, the term of this patent is extended or adjusted under 35 U.S.C. 154(b) by 199 days.

(21) Appl. No.: 13/231,859

(22) Filed: Sep. 13, 2011

(65) Prior Publication Data

US 2012/0060438 A1 Mar. 15, 2012

Related U.S. Application Data

(63) Continuation-in-part of application No. 12/544,028, filed on Aug. 19, 2009, now Pat. No. 8,015,772.

(60) Provisional application No. 61/090,113, filed on Aug. 19, 2008.

(51) Int. Cl.

| | |
|---|---|
| ***E04B 2/34*** | (2006.01) |
| ***E04B 2/00*** | (2006.01) |
| ***E04B 2/32*** | (2006.01) |

(Continued)

(52) U.S. Cl.

CPC ... *E04B 2/44* (2013.01); *E04B 2/54* (2013.01); *E04B 2002/0206* (2013.01)

(58) Field of Classification Search

CPC ..... E04B 2/44; E04B 2/46; E04B 2/54; E04B 2002/0206

USPC ..... 52/574, 503, 419, 422, 424, 432, 561, 52/608, 609, 438, 479, 483.1, 562, 565, 52/568, 571, 572, 604, 607; 405/284, 286, 405/262

See application file for complete search history.

(56) References Cited

U.S. PATENT DOCUMENTS

| | | | | |
|---|---|---|---|---|
| 1,334,600 A | * | 3/1920 | Eades | 52/410 |
| RE17,291 E | * | 5/1929 | Munson | 52/430 |

(Continued)

FOREIGN PATENT DOCUMENTS

| | | | |
|---|---|---|---|
| AT | 245208 B | | 2/1966 |
| CA | 2142517 A | * | 8/1995 |
| WO | WO 2013039599 A1 | * | 3/2013 |

OTHER PUBLICATIONS

One Step Building System webpages [online], [retrieved from Internet <URL: http://www.onestepbuildingsystems.com on Apr. 3, 2012].

(Continued)

*Primary Examiner* — Rodney Mintz

(74) *Attorney, Agent, or Firm* — Craig M. Stainbrook; Stainbrook & Stainbrook, LLP

(57) ABSTRACT

A system for assembling two-sided walls on, through, and around a pre-installed structural steel grid. System wall units have an outer side and an inner side, the outer side being an outer wall surface, the inner side opposing an inner side of one or more wall units on an opposing side of the structural steel grid. Interlock elements extend through spaces in the structural steel grid and connect opposing wall units to prevent separation of the opposing wall units. Installed in courses, the wall units create a continuous void between opposing wall units, such that structural void fill material can be poured into the assembled wall at one or more openings, and the void fill material will fill the continuous void from the top of the wall to the bottom of the wall. Plumbing, electrical, and other building systems can be installed on the steel grid prior to wall assembly.

7 Claims, 38 Drawing Sheets

(51) Int. Cl.

| | |
|---|---|
| ***E04B 2/44*** | (2006.01) |
| ***E04B 2/54*** | (2006.01) |
| *E04B 2/02* | (2006.01) |

(56) References Cited

U.S. PATENT DOCUMENTS

| | | | | | |
|---|---|---|---|---|---|
| 1,990,797 | A * | 2/1935 | Olsen | 52/429 |
| 2,137,153 | A * | 11/1938 | Brozek | 52/574 |
| 2,792,704 | A * | 5/1957 | Kooiman | 52/503 |
| 3,310,924 | A * | 3/1967 | Boynton | 52/565 |
| 3,693,307 | A * | 9/1972 | Muse | 52/438 |
| 3,780,484 | A * | 12/1973 | Muse | 52/585.1 |
| 3,962,842 | A * | 6/1976 | Wilhelm | 52/436 |
| 4,114,335 | A | 9/1978 | Carroll | |
| 4,577,447 | A * | 3/1986 | Doran | 52/571 |
| 4,631,890 | A * | 12/1986 | Szombathelyi | 52/570 |
| 4,655,014 | A | 4/1987 | Krecke | |
| 4,703,602 | A | 11/1987 | Pardo | |
| 4,704,832 | A * | 11/1987 | Vassiliadis | 52/279 |
| 4,835,928 | A * | 6/1989 | Scott | 52/426 |
| 5,428,933 | A | 7/1995 | Phillippe | |
| 5,820,305 | A | 10/1998 | Taylor et al. | |
| 5,983,585 | A | 11/1999 | Spakousky | |
| 6,168,353 | B1 | 1/2001 | Price | |
| 6,168,354 | B1 | 1/2001 | Martin | |
| 6,250,038 | B1 * | 6/2001 | Akamine | 52/604 |
| 6,272,749 | B1 | 8/2001 | Boeshart et al. | |
| 6,298,628 | B1 * | 10/2001 | Nakao | 52/583.1 |
| 6,321,497 | B1 * | 11/2001 | Cormier | 52/425 |
| 6,430,886 | B1 * | 8/2002 | Schmitz | 52/608 |
| 6,443,662 | B1 * | 9/2002 | Scales et al. | 405/262 |
| 6,508,041 | B1 * | 1/2003 | Boot | 52/578 |
| 6,523,317 | B1 | 2/2003 | Bott | |
| 6,536,172 | B1 | 3/2003 | Amend | |
| 6,584,750 | B1 * | 7/2003 | Hanna | 52/745.1 |
| 6,588,168 | B2 * | 7/2003 | Walters | 52/604 |
| 6,615,561 | B2 * | 9/2003 | MacDonald et al. | 52/606 |
| 6,637,167 | B2 * | 10/2003 | Hanna | 52/223.7 |
| 6,651,401 | B2 | 11/2003 | Price | |
| 6,817,150 | B1 | 11/2004 | Boeshart et al. | |
| 6,871,468 | B2 | 3/2005 | Whitson | |
| 6,978,581 | B1 | 12/2005 | Spakousky | |
| 7,007,436 | B1 * | 3/2006 | Kelley | 52/605 |
| 7,765,765 | B1 * | 8/2010 | Perronne | 52/742.14 |
| 8,015,772 | B2 | 9/2011 | Jensen | |
| 8,074,419 | B1 * | 12/2011 | Humphress et al. | 52/607 |
| 8,171,693 | B2 * | 5/2012 | Banova | 52/592.5 |
| 8,201,376 | B2 * | 6/2012 | Witcher | 52/565 |
| 8,266,855 | B1 * | 9/2012 | Altararwah | 52/284 |
| 8,359,808 | B2 * | 1/2013 | Stephens, Jr. | 52/742.14 |
| 8,388,258 | B2 * | 3/2013 | Rainey | 404/6 |
| 8,549,811 | B2 * | 10/2013 | Dyson | 52/604 |
| 8,707,652 | B2 * | 4/2014 | Kim et al. | 52/605 |
| 8,720,160 | B1 * | 5/2014 | Cooper | 52/745.12 |
| 8,800,236 | B2 * | 8/2014 | Yong et al. | 52/604 |
| 8,820,024 | B1 * | 9/2014 | Abdullah et al. | 52/605 |
| 8,966,844 | B2 * | 3/2015 | Bouchard | 52/314 |
| 9,091,055 | B2 * | 7/2015 | Jensen | E04B 2/40 52/561 |
| 2001/0027630 | A1 * | 10/2001 | Moore et al. | 52/741.13 |
| 2002/0178676 | A1 * | 12/2002 | Yost et al. | 52/426 |
| 2002/0187010 | A1 * | 12/2002 | MacDonald et al. | 405/284 |
| 2007/0151191 | A1 * | 7/2007 | August | 52/604 |
| 2007/0193165 | A1 * | 8/2007 | Stokes | 52/404.1 |
| 2007/0245660 | A1 * | 10/2007 | Scott et al. | 52/438 |
| 2009/0113835 | A1 * | 5/2009 | Banova | 52/604 |
| 2010/0043336 | A1 * | 2/2010 | Jensen | 52/604 |
| 2010/0162649 | A1 * | 7/2010 | Boot | 52/426 |
| 2011/0047921 | A1 | 3/2011 | Witcher | |
| 2011/0258957 | A1 * | 10/2011 | Virnich | 52/562 |
| 2011/0318100 | A1 * | 12/2011 | Rainey | 404/6 |
| 2012/0031031 | A1 * | 2/2012 | Rulon | 52/503 |
| 2012/0151862 | A1 * | 6/2012 | Daoust et al. | 52/569 |
| 2013/0081353 | A1 * | 4/2013 | Jensen | 52/742.1 |
| 2013/0104472 | A1 * | 5/2013 | Carolan et al. | 52/204.1 |
| 2013/0333313 | A1 * | 12/2013 | Alsayed et al. | 52/220.1 |
| 2014/0053493 | A1 * | 2/2014 | Carey | 52/604 |
| 2014/0150361 | A1 * | 6/2014 | Castonguay et al. | 52/309.4 |
| 2014/0250819 | A1 * | 9/2014 | Abdullah et al. | 52/605 |
| 2014/0298747 | A1 * | 10/2014 | Castonguay et al. | 52/562 |

OTHER PUBLICATIONS

IntegraSpec. The User Friendly ICF [online], [retrieved from Internet <URL:http://www.integraspec.com on Apr. 3, 2012].

Logix Insulated Concrete Forms. [online], [retrieved from Internet <URL:http://www.logixicf.com on Apr. 3, 2012].

Lite Form Technologies. ICF Wall Systems. [online], [retrieved from Internet <URL: http://www.liteform.com on Apr. 4, 2012].

Nudura Integrated Building Technology, [online], [retrieved from Internet <URL: http://www.nudura.com/en/insulatedconcreteforms.aspx on Apr. 3, 2012].

QUAD-LOCK Concrete Building Solutions, [online], [retrieved from Internet <URL: http://www.quadlock.com on Apr. 3, 2012].

PolySteel Insulating Concrete Forms, American PolySteel, LLC, ARXX Corporation, [online], [retrieved from Internet <URL: http://www.polysteel.com on Apr. 3, 2012].

ARXX ICF Insulating Concrete Forms, [online], [retrieved from Internet <URL: http://www.arxx.com on Apr. 3, 2012].

Superform, Superform Products, Ltd., [online], [retrieved from Internet >URL: http://www.superformicf.ca on Apr. 3, 2012].

Complete Construction, FormTech Insulated Concrete Forms, [online], [retrieved from Internet <URL: http://coloradocompleteconstruction.com/FORMTECH.html on Apr. 3, 2012].

Fox Block Products, [online], [retrieved from Internet <URL: http://www.foxblocks.com/Products.aspx on Apr. 3, 2012].

The Greenblock Design, Greenblock Insulated Concrete Forms, [online], [retrieved from Internet ,URL: http://greenblock.com on Apr. 3, 2012].

Buildblock Insulating Concrete Forms, BuildBlock Building Systems, LLC, [online], [retrieved from Internet <URL: http://www.buildblock.com on Apr. 3, 2012].

Smartblock ConForm Global, [online], [retrieved from Internet <URL: http://www.smartblock.com on Apr. 3, 2012].

Reddiform Insulating Concrete Forms, [online], [retrieved from Internt <URL: http://reddiform.com on Apr. 3, 2012].

ICF Block, Concrete Forms Molds, Amvic ICF, [online], [retrieved from Internet <URL: http://www.amvicsystem.com/icf-block on Apr. 3, 2012].

* cited by examiner

INTERLOCKING WALL UNIT SYSTEM FOR CONSTRUCTING A WALL ON A PRE-EXISTING STRUCTURAL GRID MATRIX

CROSS REFERENCES TO RELATED APPLICATIONS

The present application is a continuation-in-part of U.S. Utility patent application Ser. No. 12/544,028, filed Aug. 19, 2009 (Aug. 19, 2009), now U.S. Pat. No. 8,015,772, issued Sep. 13, 2011 (Sep. 13, 2011), concurrent with the filing of the instant application, which claims the benefit of Provisional Patent Application Ser. No. 61/090,113, filed Aug. 19, 2008 Aug. 19, 2008).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates to unit-shaped masonry blocks and/or EPS foam blocks, and more particularly to stackable block wall unit configurations, and still more particularly to a stackable block wall units having male and female elements that cooperate with complementary female and male elements on opposing, adjoining and/or interlocking blocks (variously referred to herein either as "blocks" or "wall units") to create an interlocking and/or bracket-assisted one, two-, or three-unit module from a single or limited design elements. Each interlocking module comprises a portion of a course in a concrete masonry unit wall or insulating concrete form wall, and all embodiments of the inventive system can be employed to build a complete wall through and around a pre-existing structural steel grid matrix.

2. Background Discussion

Masonry construction blocks and methods for constructing various kinds of brick or block walls are well known in the art. Because of the difficulty and high cost of constructing walls of quarried stone or block, cast concrete masonry units (CMU) and insulating concrete form (ICF) blocks and systems long ago replaced quarried stone as a preferred material in many applications.

Cast blocks typically have a uniform size and shape, include at least one cavity, and frequently permit physical interlocking, either vertically or horizontally, with integrally formed or independent connection means. Such interlocking designs facilitate rapid assembly and proper alignment during fabrication. They also permit assembly without mortar, so that some designs of cast blocks may be employed for temporary walls that can be easily disassembled.

Walls constructed of cast blocks may rely exclusively on the mass of the blocks to maintain alignment and stability. However, cementitious cast block walls intended for permanent use usually require additional stability. Accordingly, many designs call for the introduction of reinforcement bar extending between blocks, as well as mortar or reinforced concrete to be poured or injected into (and to fill) voids and/or gaps and aligned vertical and horizontal openings in the blocks.

However, along with their advantages, the known cast blocks also have many disadvantages, including: difficulty in converting the wall units into end or corner units; lateral instability; vulnerability of exposed mortar to chemical or environmental degradation; expansion and contraction of mortar, which causes cracking and separation of blocks; and difficulty in constructing curved configurations. A significant disadvantage of conventional, structural CMU and/or ICF block wall construction is in the awkwardness in placing block units over and around vertical steel reinforcement bars (rebar) and the time required to place horizontal rebar between block unit placements. Finally, many designs are simply not pleasing to the eye.

The following are among the exemplary stackable block systems known in the art:

U.S. Pat. No. 6,168,353, to Price, shows a retaining wall comprising blocks shaped to prevent the escape of material used to fill the cavities of the wall while allowing dissipation of pressures exerted on the wall by retained earth. The method of constructing the wall takes advantage of continuous and uninterrupted vertical cavities formed by the shape of the blocks, which includes a front portion interconnected to a rear portion which has ears on opposite sides which cooperate on adjacent blocks to create a tortuous path into a space created between two adjacent blocks.

U.S. Pat. No. 6,168,354 to Martin, et al, teaches a modular wall block having a locking shear key that extends outwardly from either the top or bottom of the block. A severable area formed with the shear key and can be removed to accommodate placement and orientation of the wall block between respective adjacent sides of like blocks in an adjacent upper or lower course.

U.S. Pat. No. 6,523,317, to Bott, et al, describes a trapezoidal wall block having parallel front and rear surfaces and opposed top and bottom surfaces. The top surface has front and rear lips with mutually opposed triangular portions converging inwardly to define opposed and aligned front and rear apices. The bottom surface of the block includes a central base with opposed notches formed along the front and rear edges of the bottom surface, with the base having a trapezoidal configuration with a width dimension which is no greater than the spacing between the opposed aligned front and rear apices.

U.S. Pat. No. 6,615,561 to MacDonald, et al, teaches a retaining wall block with a core, pin receiving cavities, and pin holes. The pin receiving cavities and pin holes are arranged symmetrically on the block and outside of the corner segments.

U.S. Pat. No. 6,651,401, to Price, et al, shows a retaining wall that calls for a series of differently sized, pre-formed horizontal and vertical blocks. Each block includes a projection and a recess, with the projection and recess arranged and configured so that each projection effectively engages a recess in an adjacent course to operatively connect adjacent courses together.

U.S. Pat. No. 6,871,468, to Whitson, describes an interlocking masonry wall block with two spaced lugs or projections and a cooperating recess or channel. The block can be stacked in courses in a staggered configuration such that each block is stacked atop two immediately lower blocks. In each embodiment, the lugs and their cooperating channel or recess define a setback dimension.

Known prior art products include the APEX block made by Apex Construction Systems of Portland, Oreg.

Rastra Block, by Rastra Corporation of Scottsdale, Ariz., is increasingly seen as making a meaningful contribution to green construction practices. It is a composite insulating concrete form (ICF) wall-construction material made from concrete and pelletized recycled styrofoam. It is formed in elongate panels having a plurality of holes that align with adjoining blocks when stacked. This forms contiguous vertical and horizontal channels for the placement and containment of rebar and concrete fill.

Perform Wall Panel Systems, by Perform Wall, LLC, of El Paso, Tex. utilizes another insulated concrete form quite similar to Rastra blocks. It is made of a combination of cement, polystyrene, water, and additives. The panel stack geometry creates a grid pattern that produces voids for placement of rebar and concrete in-fill. A wall constructed from these forms purportedly provides a fire, sound and thermal barrier that is virtually impervious to earthquake, fire, wind, water, heat and cold.

The foregoing patents and prior art products reflect the current state of the art of which the present inventor is aware. Reference to, and discussion of, these patents and products is intended to aid in discharging Applicant's acknowledged duty of candor in disclosing information that may be relevant to the examination of claims to the present invention, when such claims are presented in a non-provisional patent application. However, it is respectfully submitted that none of the above-indicated patents disclose, teach, suggest, show, or otherwise render obvious, either singly or when considered in combination, the invention described and claimed herein.

SUMMARY OF THE INVENTION

The present invention is a system for rapidly assembling a two-sided wall on, through, and around a pre-installed structural steel grid. The system can be implemented using three classes of system elements: (1) a single unit interlocking system; (2) a multi-unit interlocking system; and (3) a bracket-assisted interlocking system. Each system includes wall units, each having an outer face and an inner face, with the outer face functioning as an outer wall surface after installation, and the inner face opposing an inner face of at least one other wall unit on an opposing side of the structural steel grid. Additionally, the systems each include interlock elements. In the case of the single unit systems, the interlock elements are disposed on the back (or inner) face of the wall units. In the case of the multi-unit and bracket-assisted systems, the interlock elements are separate structures that connect or couple opposing wall units. When installed on a wall, most of the interlocking elements in the wall extend through a space in the structural steel grid and span from at least an inner face of one wall unit to another wall unit at the same course level so as to prevent separation of opposing wall units. When installed in courses around the structural steel grid, the wall units and the interlock elements create a continuous void in the space between wall units placed on opposing sides of the structural steel grid, and the voids between any two opposing wall units are in fluid communication with the voids between any all other wall units in the assembly, such that structural void fill material can be introduced into the continuous void at one or more places in the constructed wall. Because the voids are continuous, the void fill material will fill the continuous void from the top of the wall to the sides and bottom of the wall.

As will be described in more detail below, the preferred embodiments of the stackable block wall units of the present invention include a substantially planar front face, a first edge, a second edge, a first end, a second end, and a back face. In the preferred embodiments of the single unit systems using the inventive wall units, projecting outwardly from the back face is at least one male interlocking element. This male element is (or in the case of more than one element, these elements are) connected to and integral with the back (inner) face and are configured to cooperate with either an identical male element on an opposing wall unit (i.e., a wall unit on the opposite side of the grid matrix, the opposing male element either being inverted or reversed (rotated either about a horizontal or vertical axis of the wall unit) in relation to its complementary male element so as to present a configuration in which either the two elements can be approximated to form an interlocking connection; alternatively, each male element may cooperate with female features on the back side (inner face) of the opposing wall unit to form an interlocking connection. In some embodiments, the male elements of adjoining wall units also cooperate to enhance the structural integrity of the wall.

In a first preferred embodiment of the single unit interlocking system, the male elements include a tapering leg portion which expands proximally to distally as it projects and extends into an ankle portion. The ankle portion further expands into a foot or shoe portion, which has structural features that may be conveniently compared to the elements typically forming a shoe, including a planar sole, an outboard upper portion, an inboard upper portion, each being generally normal to the planar sole and adjoining the sole in outboard and inboard edges, a generally flat toe, a heel, a vamp, and a topline.

The units next include a female interlocking element integrally formed as a female concavity in each of the leg and ankle portions of the male interlocking elements. Accordingly, the female interlocking elements include a sole side and approximates the sole of the male element, a medial upper side that approximates the inboard upper portion of the male element, a lateral upper side that approximates the outboard upper portion of the male element, and so forth.

To combine wall units into an interlocked pair, the back faces are put into an opposing position and the male elements of one wall unit are oriented in toe up position (i.e, rotated vertically or on their horizontal axis) while the male elements of the opposing wall unit are oriented with the male elements in a toe down position. Thus, when two of the inventive monolithic wall units are aligned for interlocking relationship with one another, the female interlocking elements on one of the wall units accepts and conforms precisely to corresponding complementary male interlocking elements on opposing wall units. In effecting the mating relationship, the heel portions of the male interlocking elements on one wall unit slidingly insert into the female concavities on an opposing wall unit to form upper and lower interlocked wall units. The combination of two opposing wall units at the same level form a portion of a course in a wall.

In other single unit system embodiments, the male interlocking elements can be configured similarly, though perhaps more simply, but in every instance, once the interlocking elements are brought into the interlocked configuration, the opposing blocks resist separation from one another. This is also true of bracket-assisted and multi-unit embodiments, the only difference residing in the discrete nature of the bracket or connecting unit; that is, the bracket is a cross-over interlocking unit separate and apart from the wall units, whereas in the single unit interlocking wall units, the male and female elements are integral with the back side of the unit.

When using any of the preferred embodiments of the present invention, the wall units can be assembled through and around a prefabricated, pre-installed structural steel grid matrix, thereby entirely eliminating any need to handle and connect reinforcement elements as the job progresses. Further, pipes for plumbing and electrical chases and/or wiring itself, as well as other suitably sized building systems, can be hung on the grid matrix before wall unit placement so that such systems can be essentially completed before the wall construction is even begun.

It is therefore a principal object of the present invention to provide a new and improved block building unit that interlocks with one or more identical units and stacks atop and/or below identical units to form a wall, and when so configured the interlocking units form horizontal and vertical voids suitable for accepting void fill material.

A further object of the present invention is to provide a new and improved structural building unit having a novel design that enables prefabrication and unit placement of a grid or matrix of steel reinforcement bars and the subsequent placement of interlocking wall units around the pre-placed rebar grid, including unit installation through and around a pre-existing grid matrix from one side.

Still another object of the present invention is to provide a structural building unit in which interlocking of units requires no adhesive, mortared joints, or external shoring and bracing while the internal voids formed by the combined units can be filled with void fill material, such as flowable fill material, concrete, mortar, grout, loose particulate fill material, or any of a number of suitable void fill materials that increase structural integrity, thermal insulation, sound attenuation, and the like.

Yet another object of the present invention is to provide an improved block building unit in which each element of the unit can be easily adapted, sized, and scaled for specific applications.

A still further object is to provide a wall system that provides a stackable, block-based modular wall assembly system capable of providing a sub-finish or finish for a permanent wall built through and around a pre-existing and prefabricated structural steel grid matrix.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
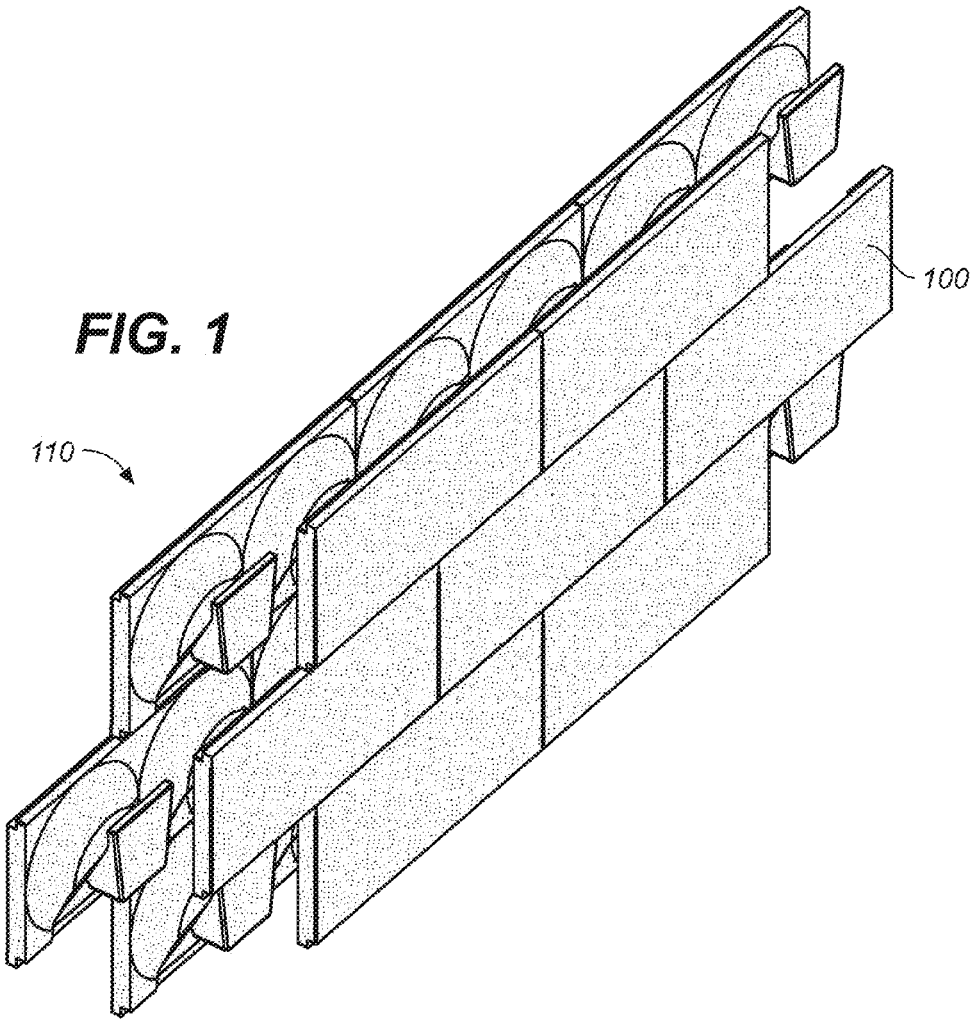
FIG. 1 is a perspective view of a wall constructed with three stacked courses of the cementitious wall unit of the present invention.

Referring first to FIGS. 1 through 20, wherein like reference numerals refer to like components in the various views, there is illustrated therein a first preferred embodiment of a new and improved interlocking lightweight wall unit and wall unit wall building system. This first preferred embodiment of the inventive wall unit is generally denominated 100 herein. A wall constructed of the inventive interlocking wall units is shown in FIG. 1 and is denominated 110. The units may be fabricated from a number of suitable materials, though preferred materials include lightweight concrete, structural concrete, cellular concrete, glass fiber reinforced concrete (GFRC), cellulose fiber reinforced concrete, geopolylmer concrete, expanded polystyrene foam (EPS foam), recycled EPS foam bead concrete, and the like.

FIG. 1 shows a wall constructed with three courses using the first preferred embodiment 100 of the cementitious wall unit of the present invention, the details of which are shown in FIGS. 5-12. FIGS. 1-4D show how the wall unit elements of the first preferred embodiment combine to form interlocking units for such a wall construction. FIGS. 13-20 depict a second preferred embodiment of the present invention.

Referring first to FIGS. 5-12, there is shown various views of one of the preferred embodiments of the cementitious wall unit of the present invention. These views collectively show that in its most essential form, the wall unit includes a monolithic cementitious unit 100 having a generally planar front face 120, a first edge 130, a second edge 140, a first (right) end 150, a second (left) end 160, a back face 170, and at least one male interlocking element 180. Preferably each wall unit includes two male interlocking elements 180*a*, 180*b*.

Each male interlocking element comprises a tapering conical leg 190 which projects and extends outwardly into an integral ankle portion 200, which, in turn, expands into a shoe portion 210. The shoe portion includes a planar sole 220, a lateral (outboard) upper portion 230, a medial (inboard) upper portion 240, a flat toe 250, a heel 260, a vamp 270, and a topline 280. The edge of the adjoining upper and sole portions define a beveled feather 290, and the edges 300 of the adjoining heel and upper portions are also beveled. The heel includes a rake portion 310 with beveling on its exposed edges 320.

Each male interlocking element includes an integral female interlocking element formed in or cut-out from the leg and ankle portions of the male interlocking element. The female interlocking element is a box shaped concavity 330 defined by a plurality of sides, including a sole side 340, a medial upper side 350, a lateral upper side 360, and beveling 370 at each of the adjoining sides to complement the beveling on the male interlocking element.

Referring to FIGS. 1-4D, it will be appreciated that the female interlocking element conforms precisely to the male interlocking element, such that the heel portion of the male interlocking element slidingly inserts into the female concavity to form upper and lower interlocked wall units 380*a*, 380*b*, respectively, comprising a portion of a course in a wall. When so inserted, the sole of the male element approximates the sole side of the female concavity; the medial upper of the male element approximates the medial upper side of the female concavity, and so forth. To supplement the interlocking features of the male and female interlocking elements, in the first preferred embodiment of the inventive wall unit, the first and second edges are rabbetted. The first edge 130 proximate heel 260 includes one or more projecting portions 130*a* on the outer boundary of the edge, while the second edge 140 proximate toe 250 includes a projecting portion 140*a* on the inner boundary of the edge. Accordingly, as the wall units are interlocked and stacked, the rabbetted edges also cooperate to form a joint that increases the structural integrity of the wall.

Figure 2:
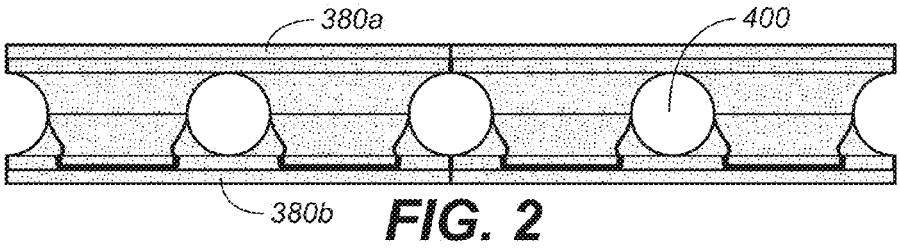
FIG. 2 is a top plan view showing the wall unit configuration in a course of wall units in which each wall unit interlocks with only one other identical wall unit.
Figure 3:
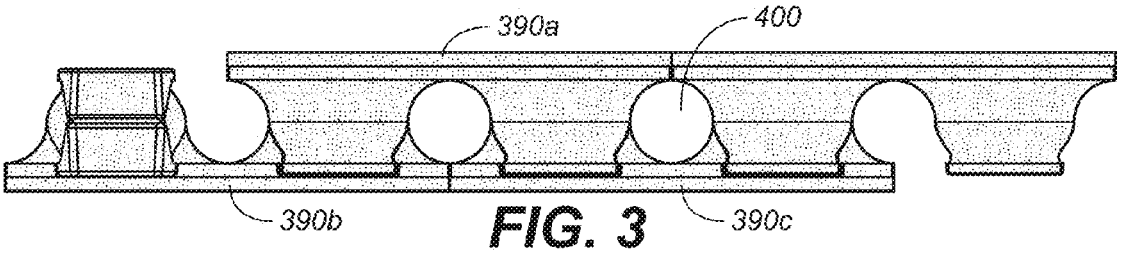
FIG. 3 is a top plan view showing the configuration of wall units in a course in which each wall unit interlocks with two other identical wall units.
Figure 4A:
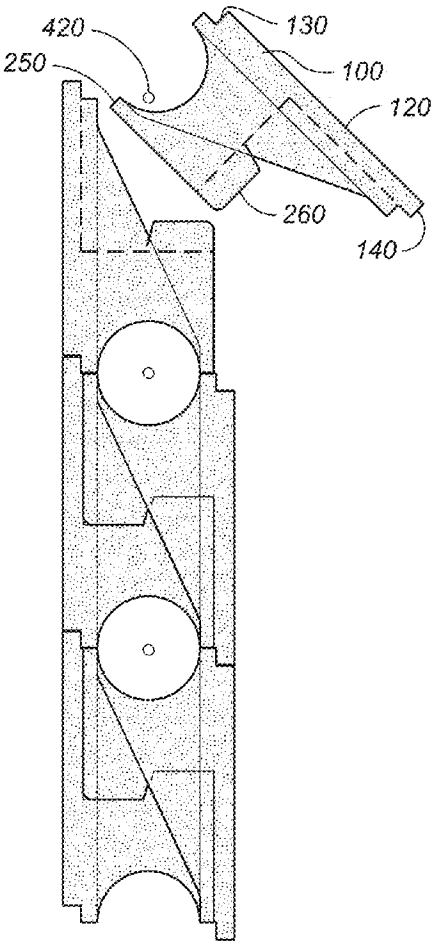
FIGS. 4A-4D are side views in elevation showing how the male element of the inventive wall unit is inserted into the complementary female concavity in an opposing wall unit to form a wall unit in a wall.
Figure 4B:
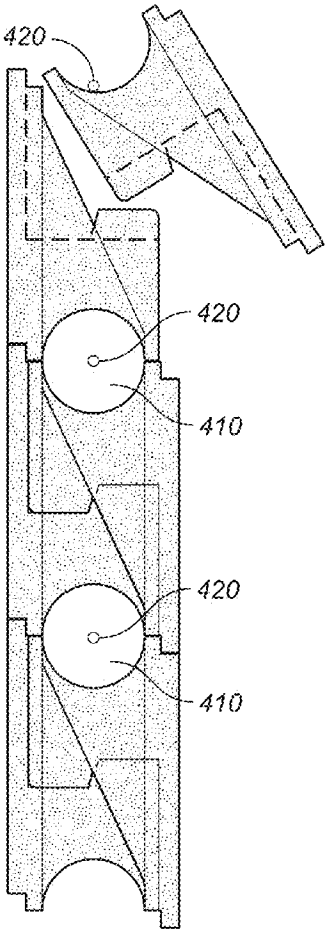
Figure 4C:
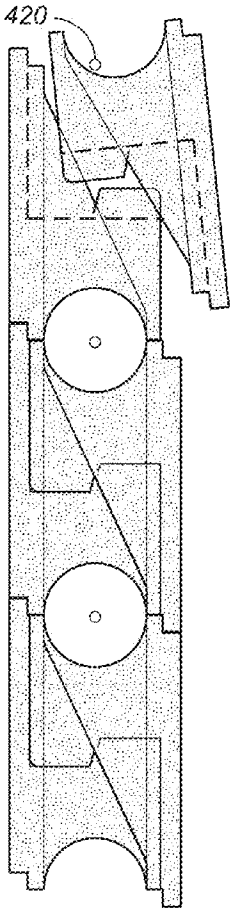
Figure 4D:
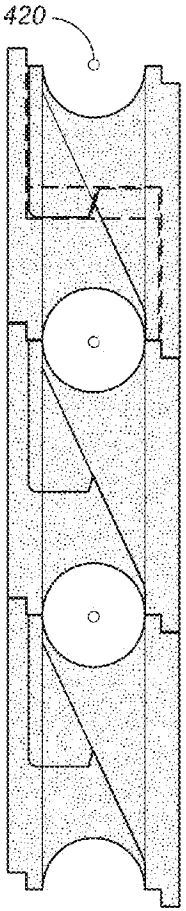
Figure 5:
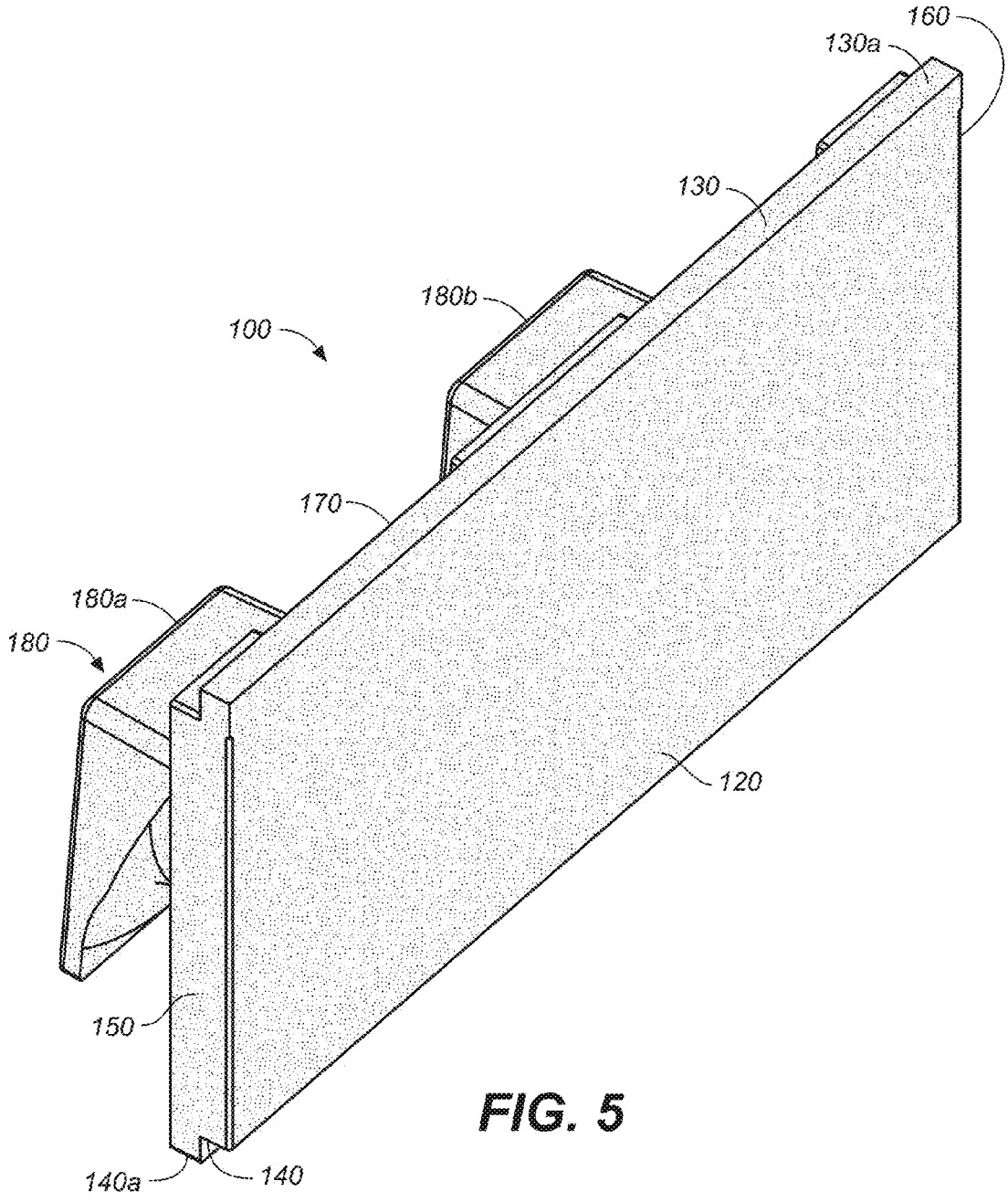
FIG. 5 is an upper right front perspective view showing the front face of a first preferred embodiment of the present invention.
Figure 6:
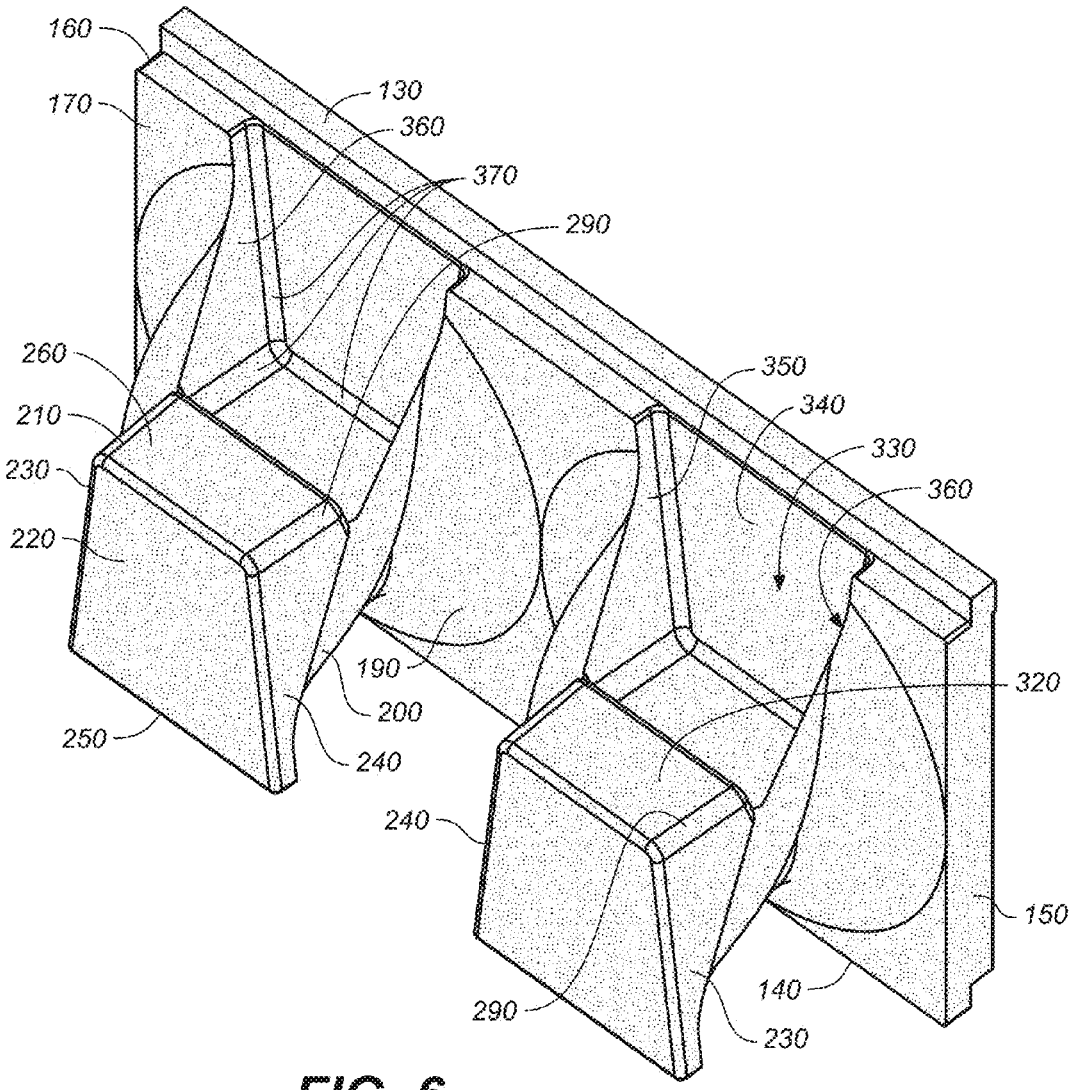
FIG. 6 is an upper right rear perspective view thereof, featuring the male projections.
Figure 7:
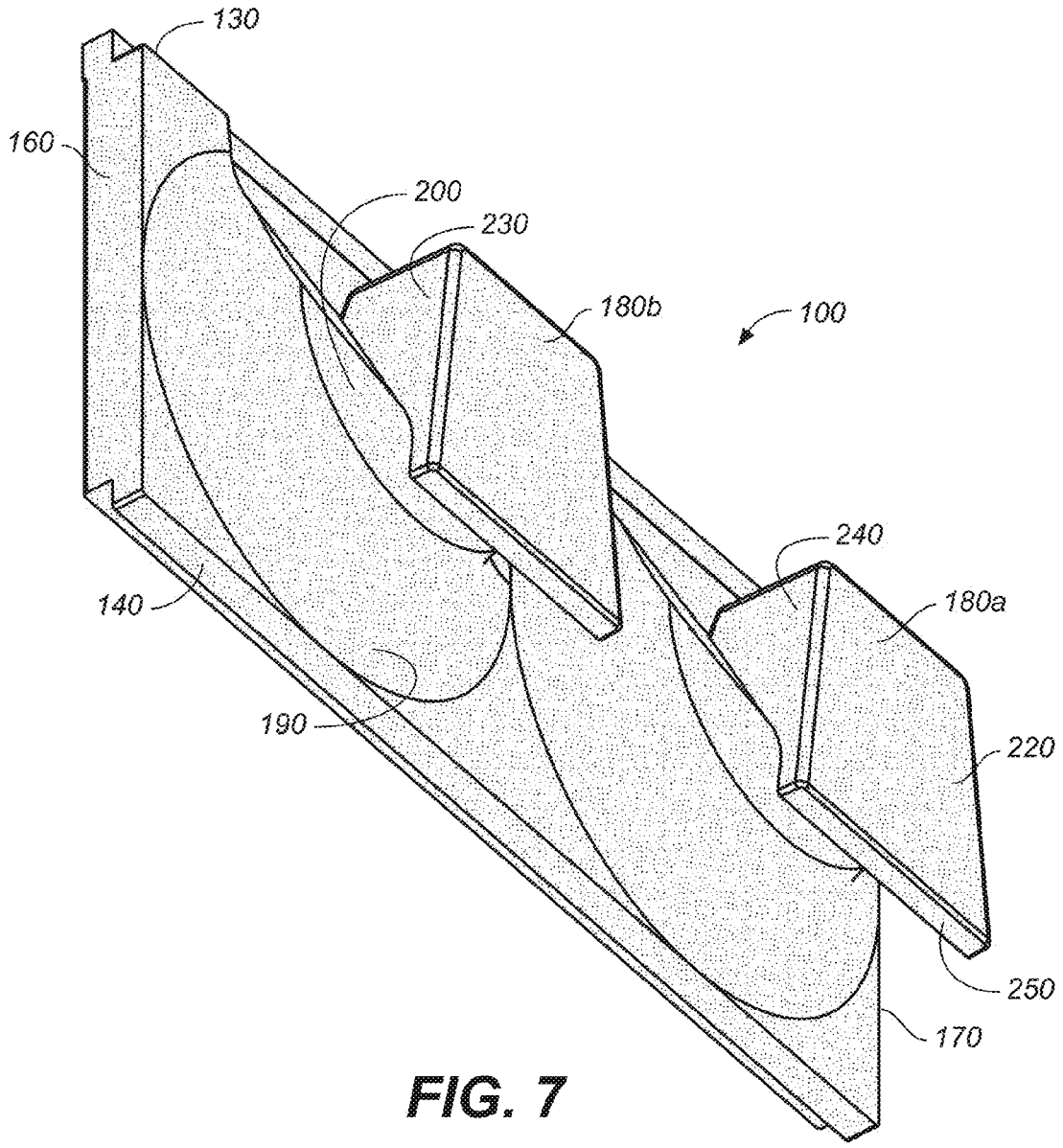
FIG. 7 is a lower left rear perspective view thereof.
Figure 8:
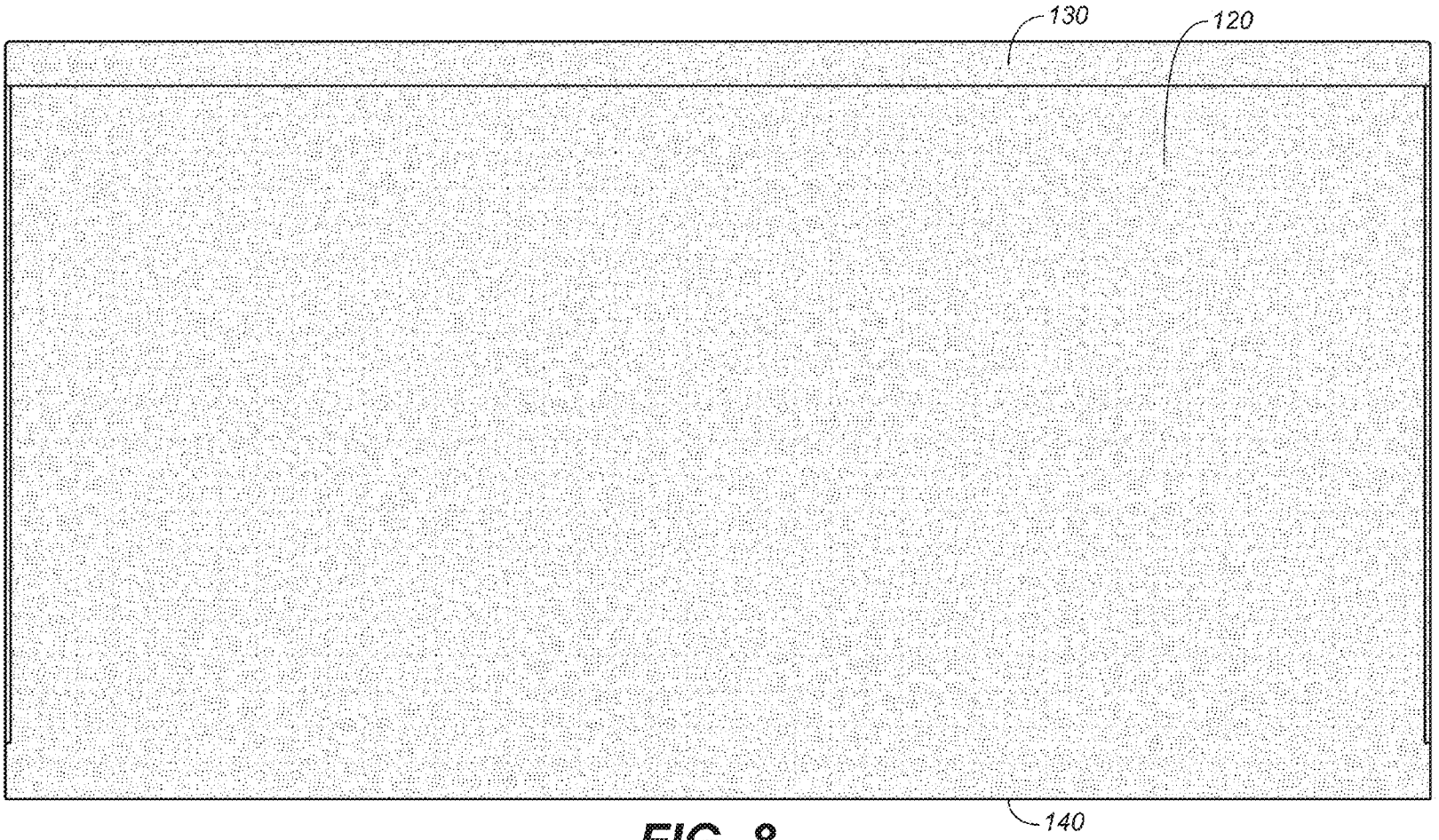
FIG. 8 is a front view in elevation thereof.
Figure 9:
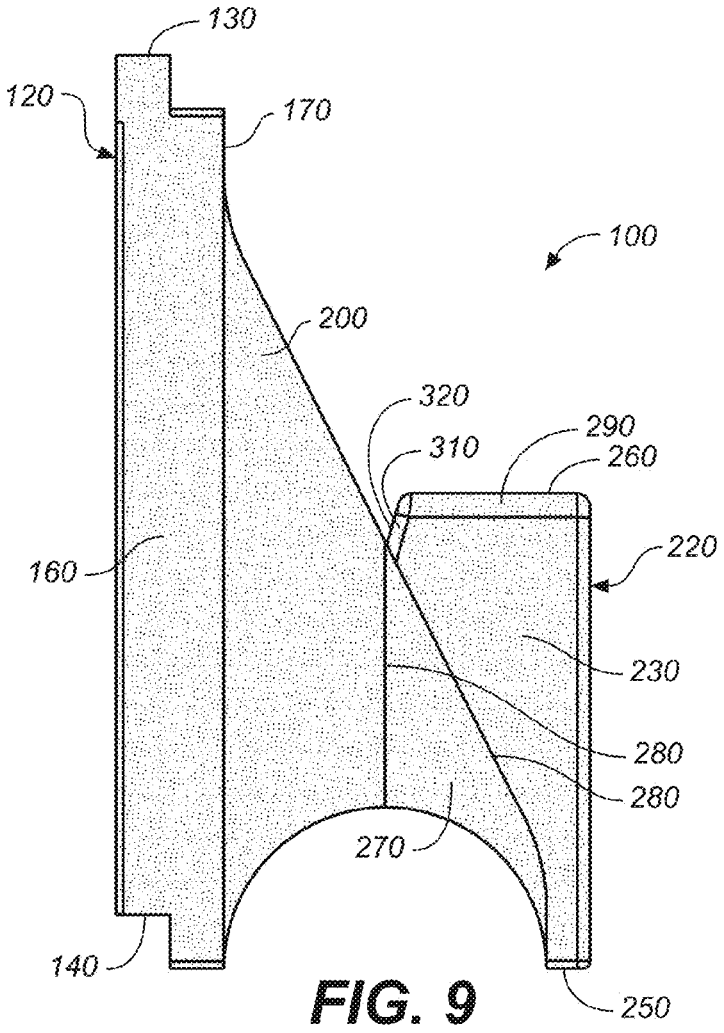
FIG. 9 is a left side view in elevation thereof.
Figure 10:
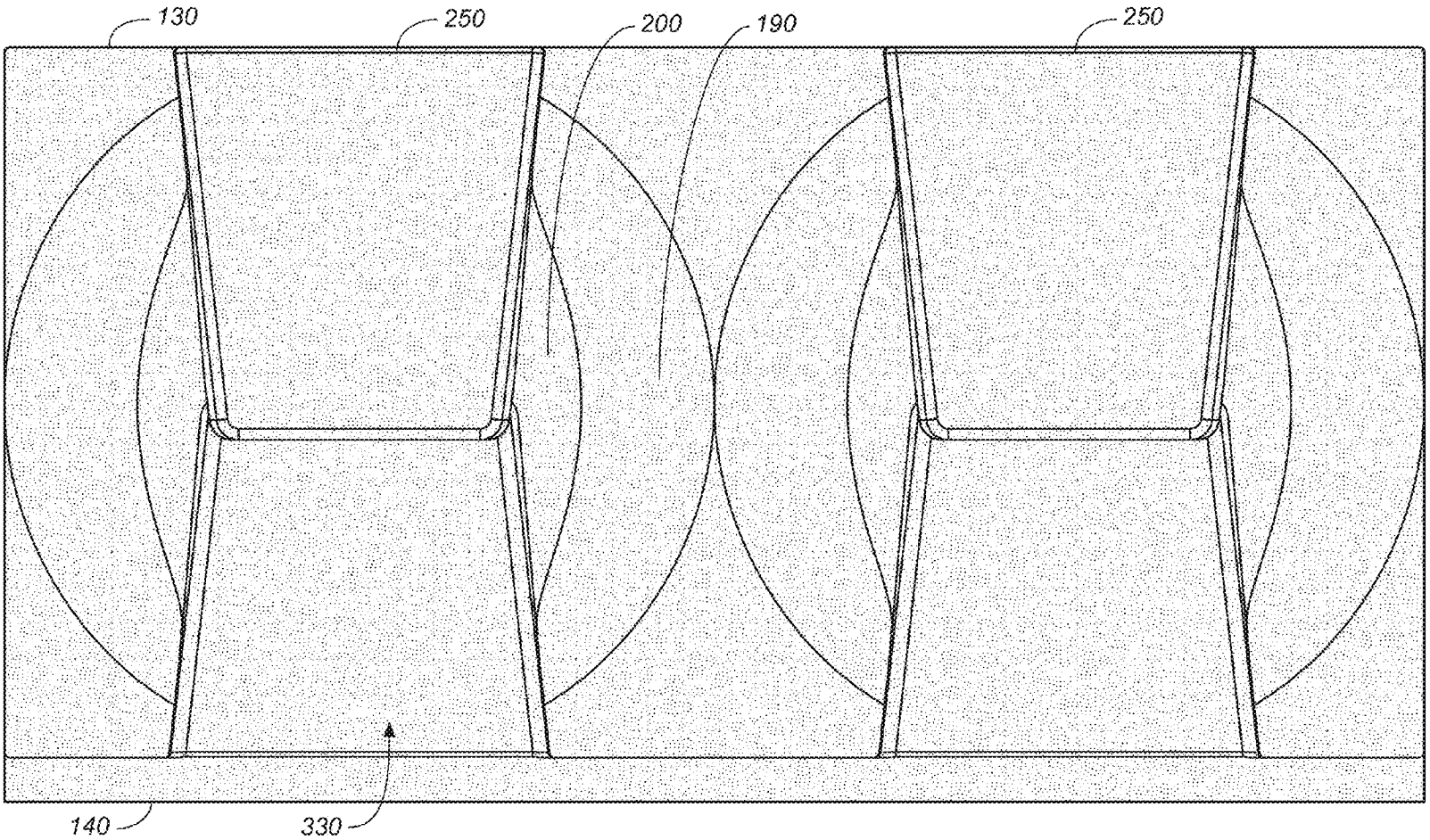
FIG. 10 is a rear view in elevation thereof.
Figure 11:
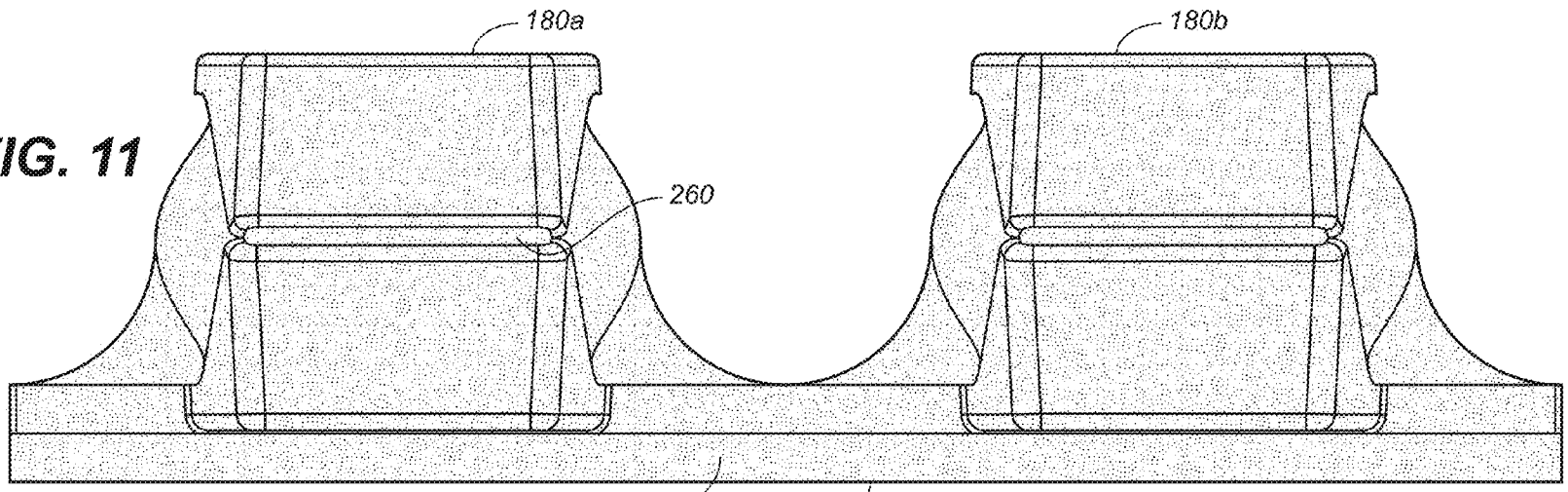
FIG. 11 is a bottom view thereof.
Figure 12:
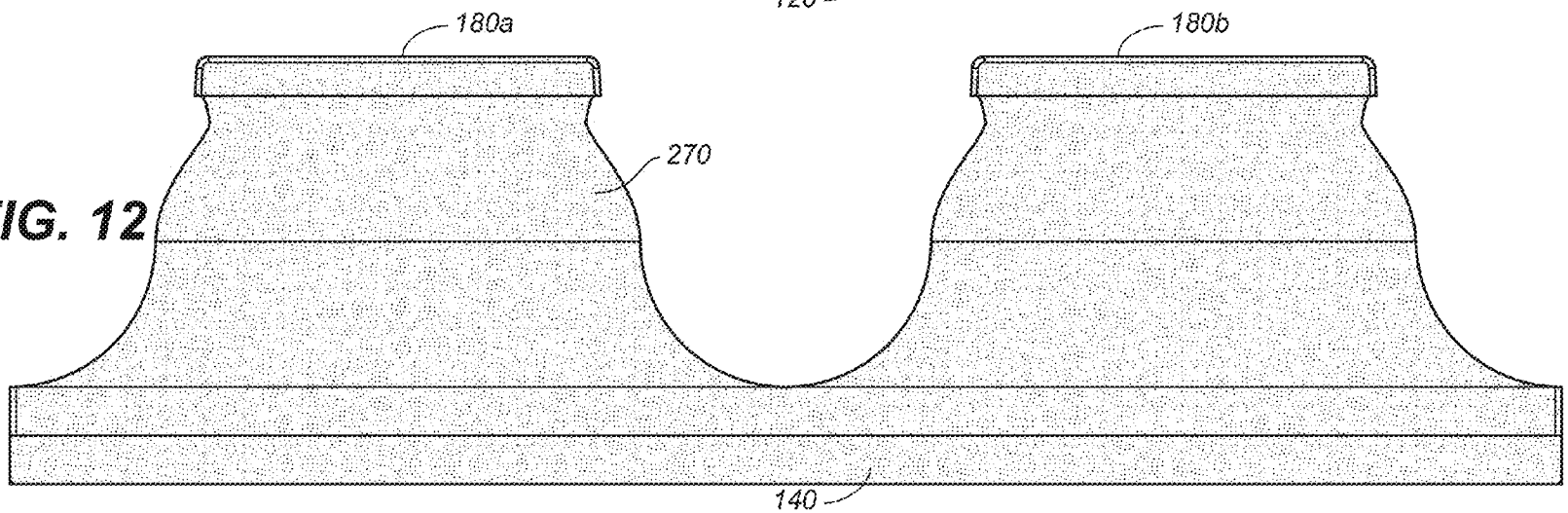
FIG. 12 is a top plan view thereof.
Figure 13:
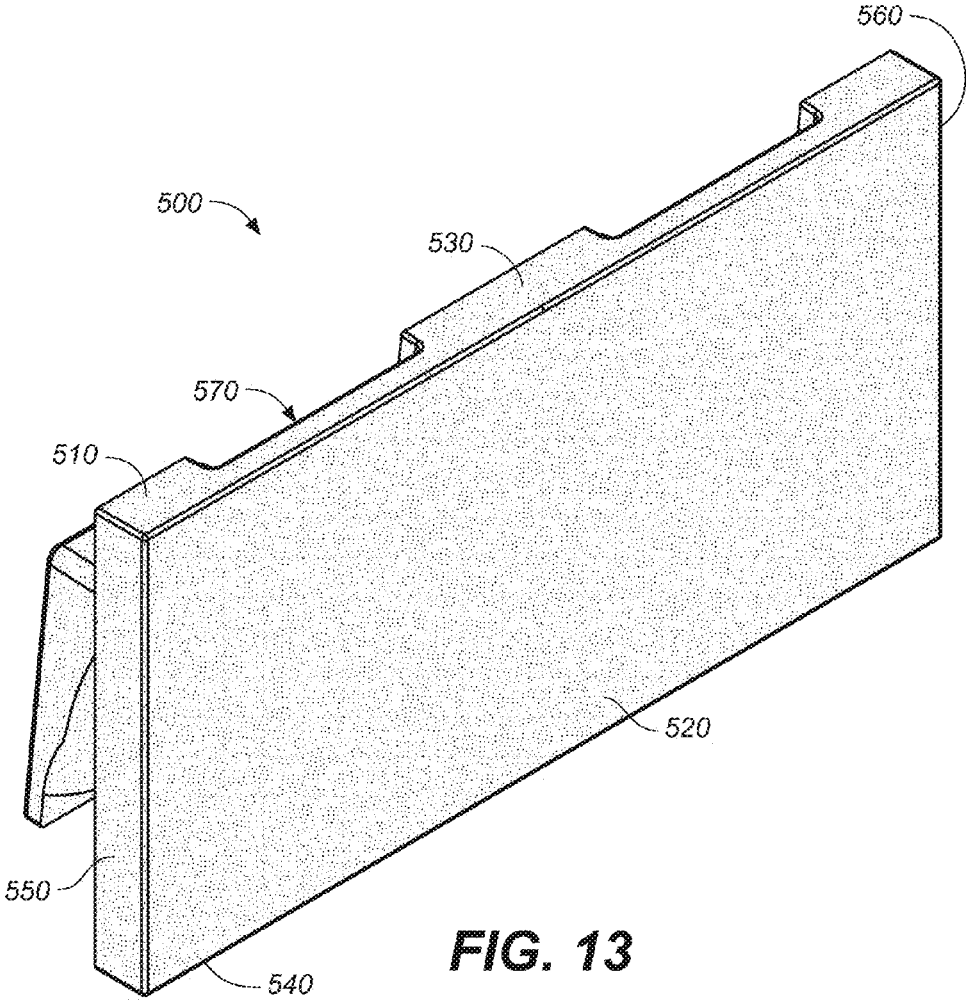
FIG. 13 is an upper right front perspective view of a second preferred embodiment of the present invention.
Figure 14:
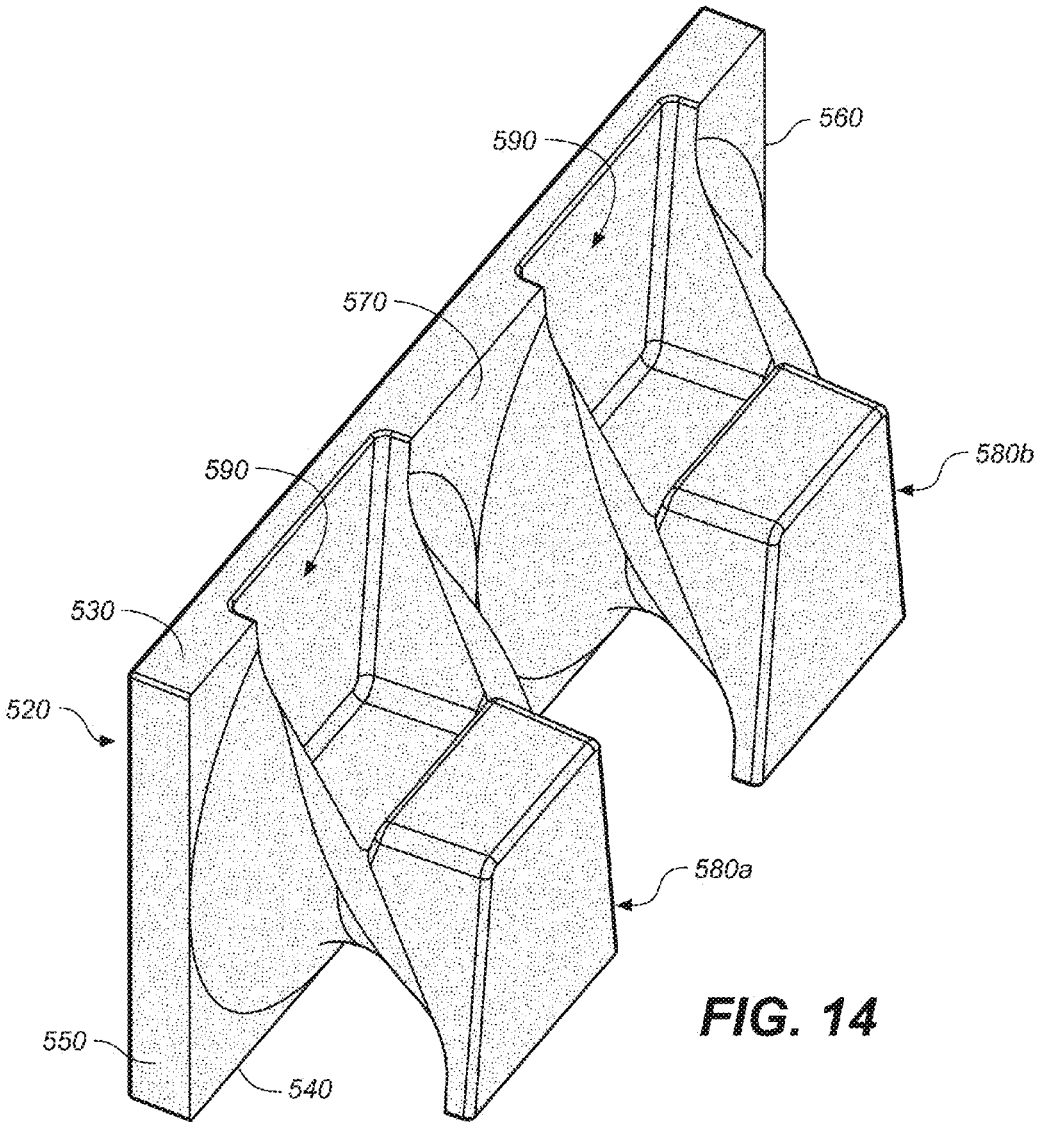
FIG. 14 is an upper left rear perspective view thereof, featuring the male projections.
Figure 15:
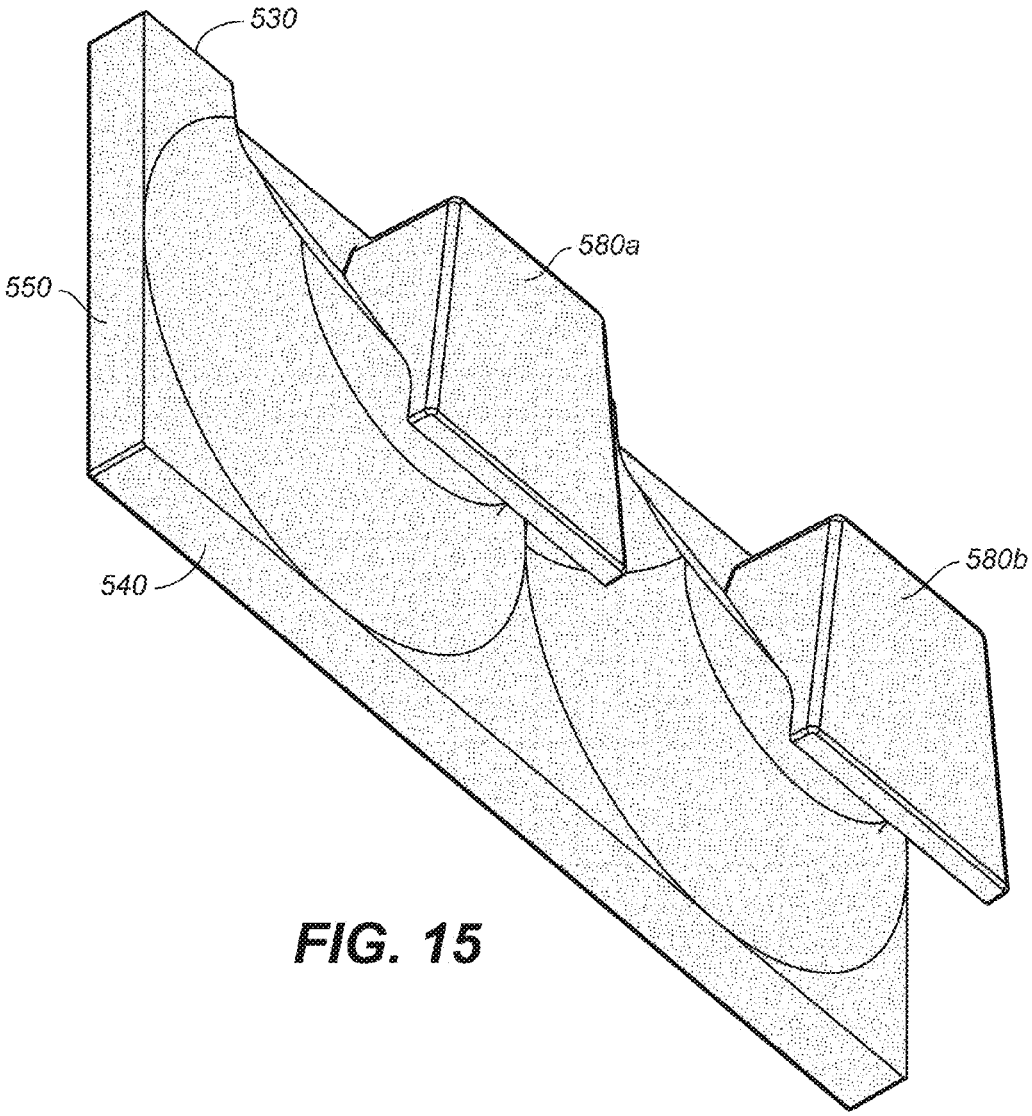
FIG. 15 is a lower left rear perspective view thereof.
Figure 16:
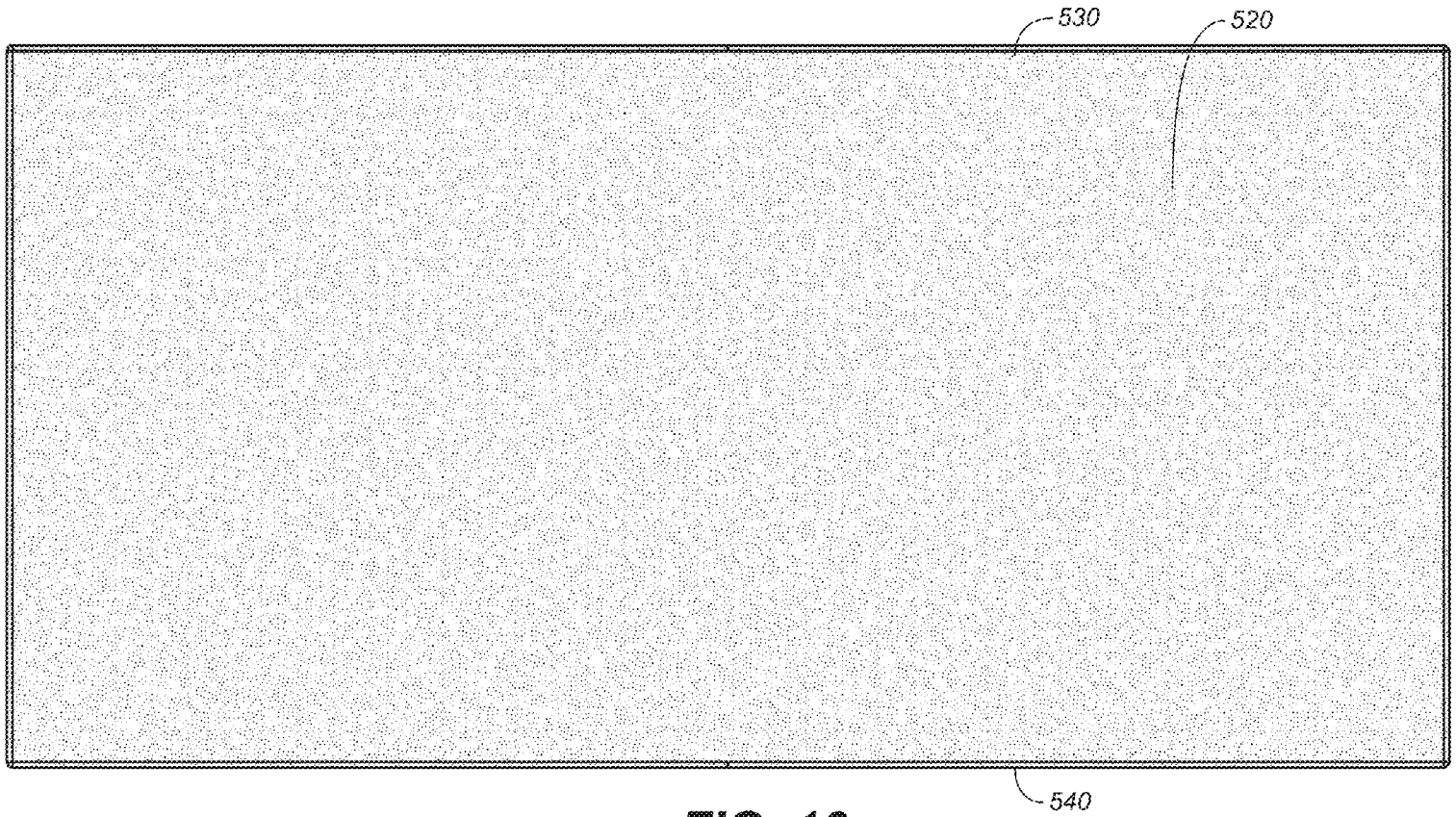
FIG. 16 is a front view in elevation thereof.
Figure 17:
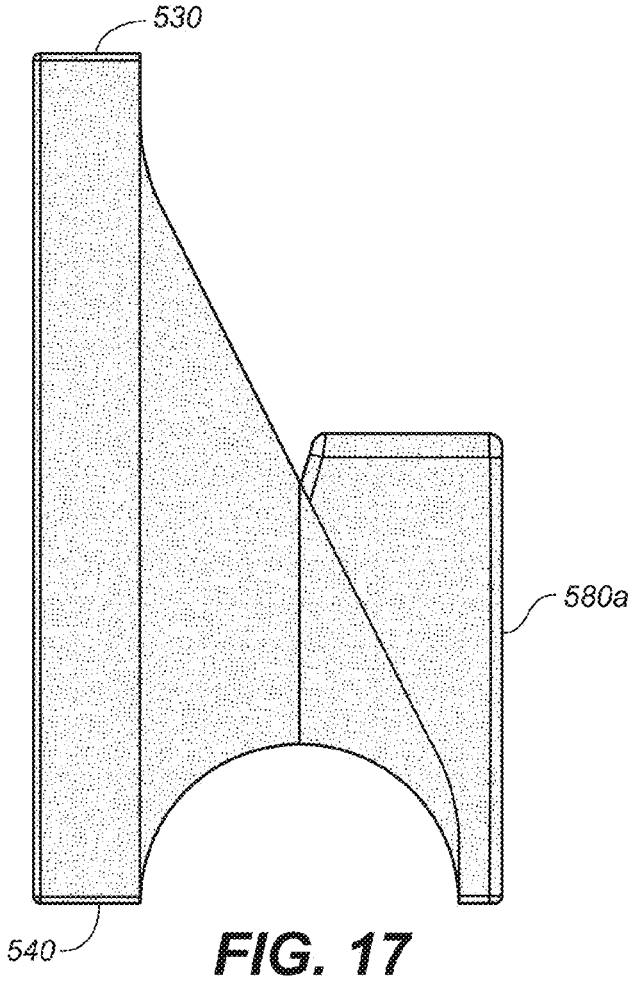
FIG. 17 is a left side view in elevation thereof.
Figure 18:
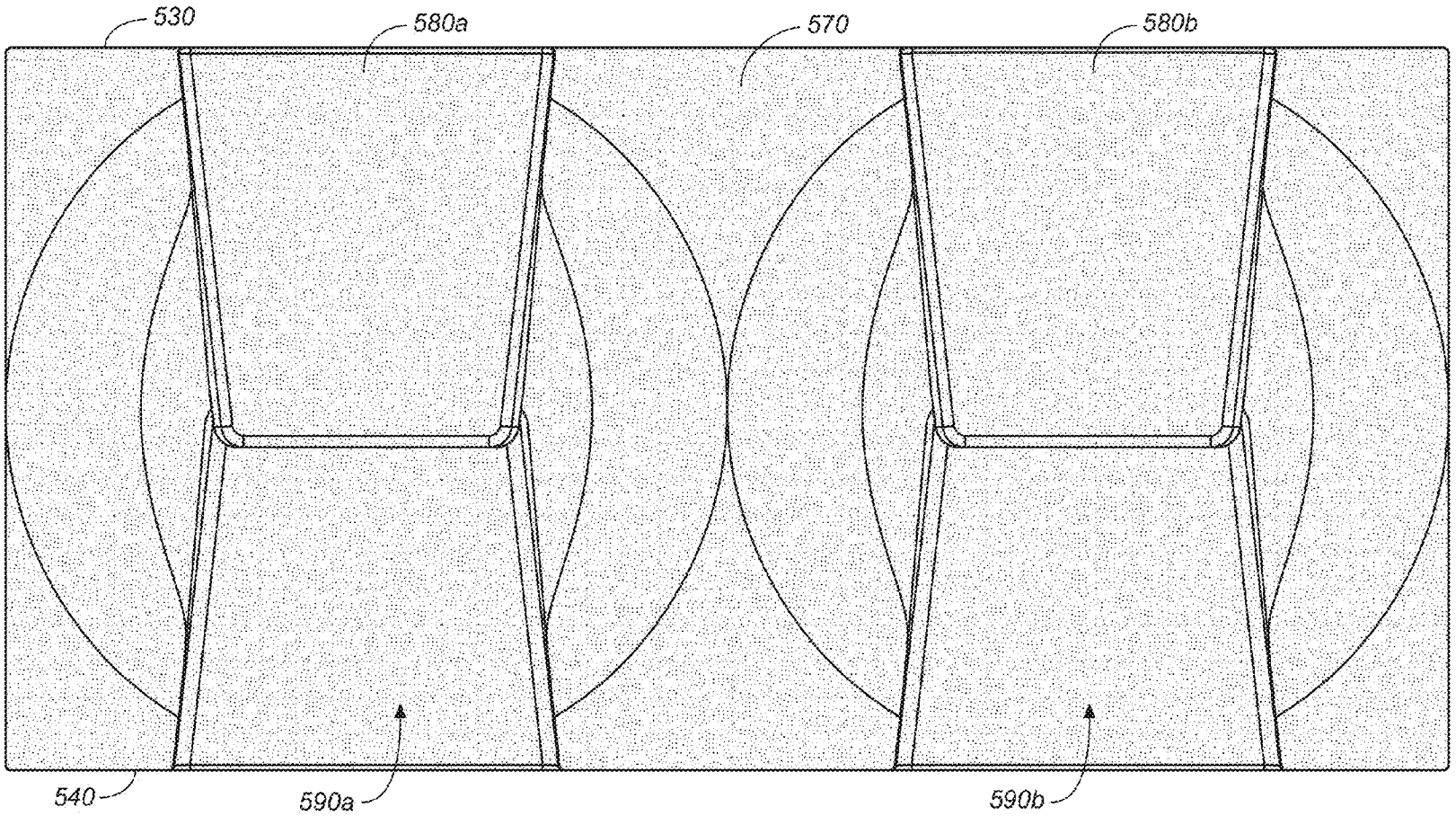
FIG. 18 is a rear view in elevation thereof.
Figure 19:
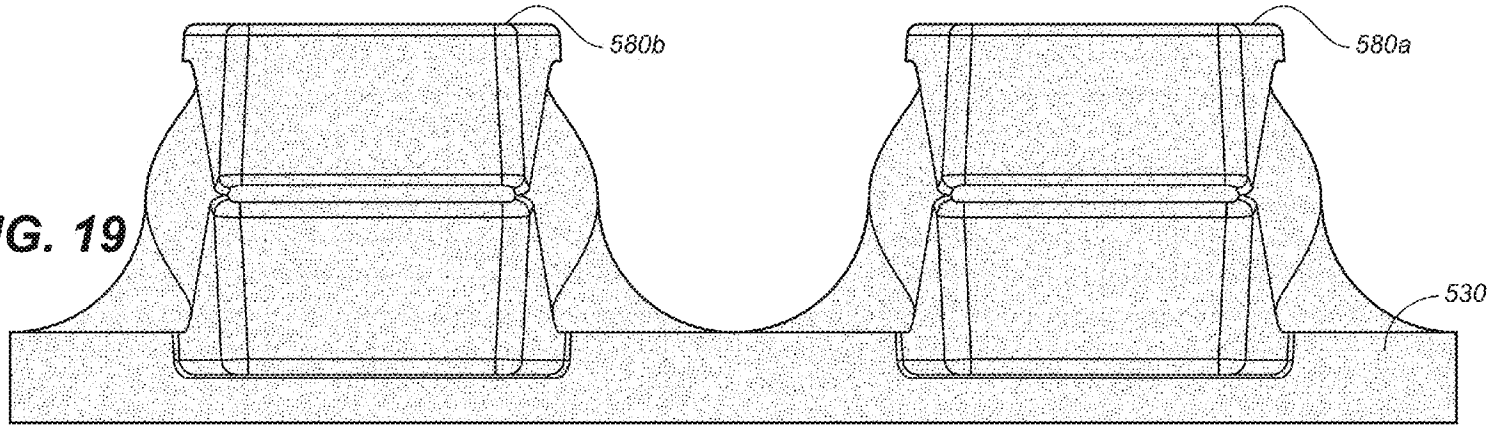
FIG. 19 is a bottom view thereof.
Figure 20:
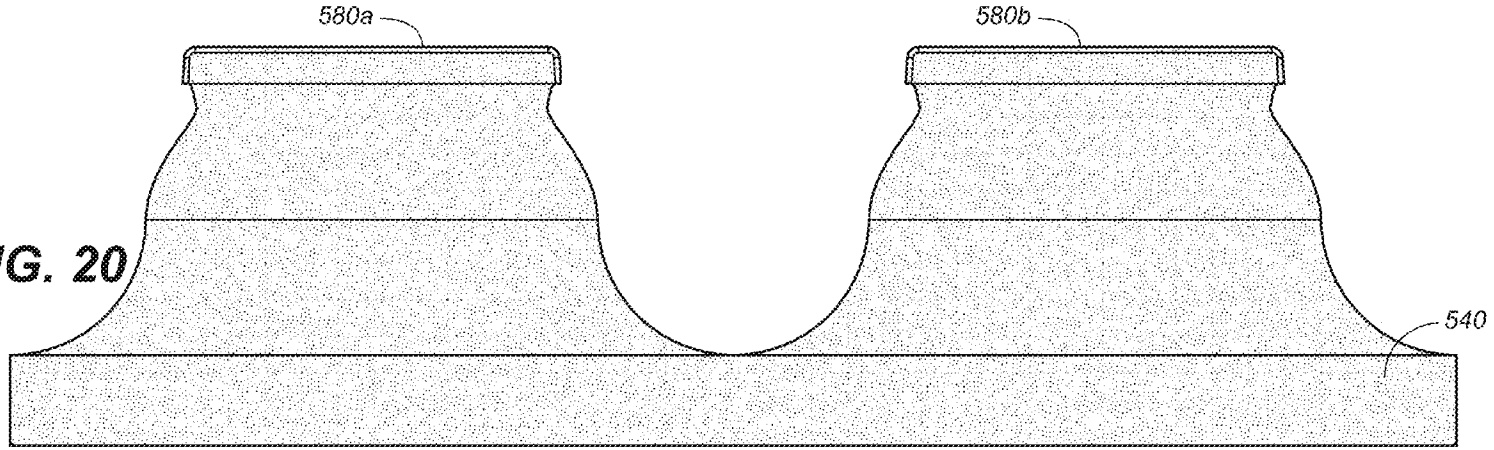
FIG. 20 is a top plan view thereof.

From FIGS. 2 and 3, it will be seen that the wall units may be joined such that each wall unit 380*a* cooperates with only one other wall unit 380*b* (see FIG. 2) or such that each wall unit 390*a* cooperates with two other wall units 390*b*, 390*c* (see FIGS. 1 and 3). In either case, the course comprises wall units that are oriented with the toe pointing down interacting with wall units oriented with the toe pointing up.

Referring now to FIGS. 2-4D, it will also be appreciated that when the wall units are interlocked and stacked, a plurality of continuous cylindrical horizontal and vertical voids 400, 410, as well as diagonal voids (not shown) are formed between the wall units. Into these voids rebar 420 may be disposed both vertically and horizontally and the voids then filled with void fill material. Preferably, a prefabricated matrix or grid of unit-placed rebar may be installed first, and the wall units may subsequently be installed and the wall constructed around and through the prefabricated grid with the intersections of the grid wired, welded, or joined with plastic cable ties, all in a manner well known in the art. In this, as in all other embodiments of the inventive system, the wall can be constructed either from both sides of the grid matrix, or from only one side.

Referring now to FIGS. 13-20, there is shown a second preferred embodiment 500 of the cementitious wall unit of the present invention. This wall unit includes all the structural features of the above-described (alternative) embodiment, including a monolithic cementitious wall unit 510 having a generally planar front face 520, a first edge 530, a second edge 540, a first end 550, a second end 560, a back face 570, and at least one male interlocking element 580. Again, preferably each wall unit includes two male interlocking elements 580*a*, 580*b*.

Male interlocking elements include elements identical to those of the first preferred embodiment, including a tapering conical leg which projects and extends outwardly into an integral ankle portion, which, in turn, expands into a shoe portion, which has a flat sole, a lateral upper portion, a medial upper portion, a flat toe, a heel, a vamp, and a topline. The edge of the adjoining upper and sole portions define a beveled feather, and the edges of the adjoining heel and upper portions are also beveled. The heel rake has beveling on its exposed edges.

Each male interlocking element includes an integral female interlocking element 590*a*, 590*b*, comprising a box shaped concavity having features identical to those of the female concavity of the first preferred embodiment, including a plurality of sides, including a sole side, a medial upper side, a lateral upper side, and beveling at each of the adjoining sides.

The structural distinction between the first and second preferred embodiments is at the edges, where in the second preferred embodiment no rabbetting is provided.

Referring next to FIG. 21A through FIG. 56, there is shown several variations of the inventive wall unit of the present invention as well as complementary elements (where called for) comprising the inventive system for assembling a wall through and around a pre-existing structural steel grid matrix.

Figure 21A:
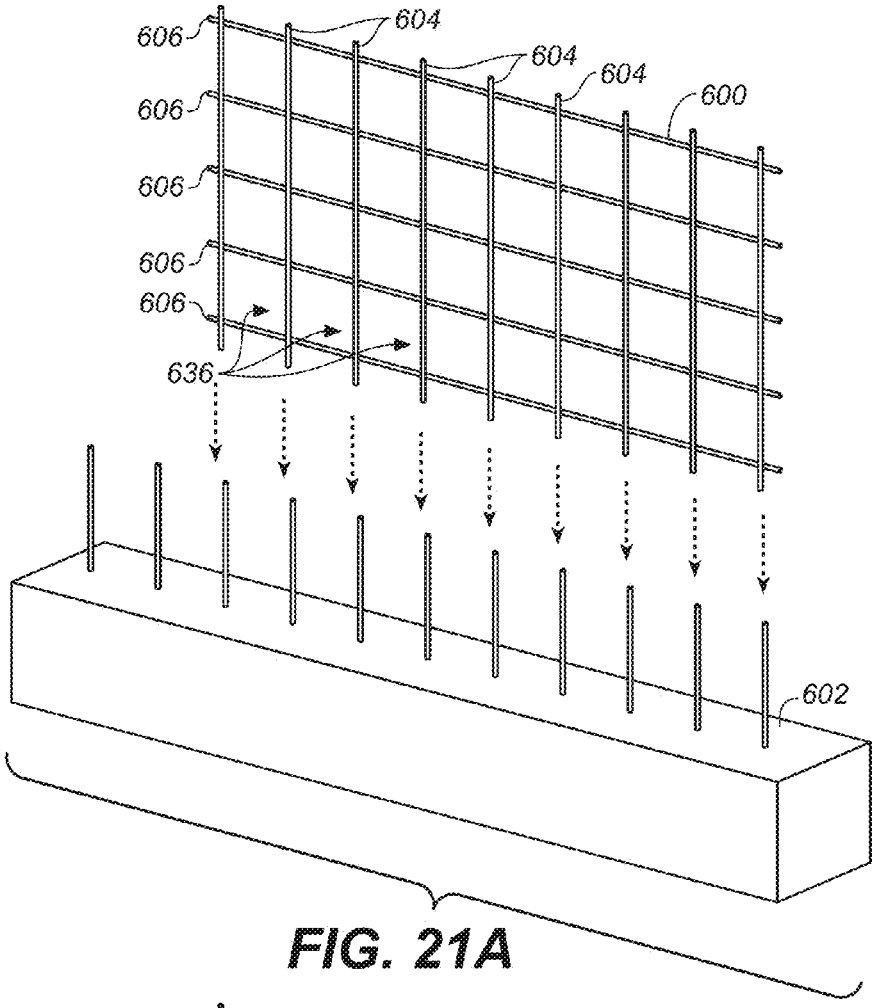
FIG. 21A is an upper perspective view of a concrete footing into which a structural steel grid matrix can be embedded and mounted so as to provide the scaffolding and foundation on which a wall using units of the inventive wall system can be built.
Figure 21B:
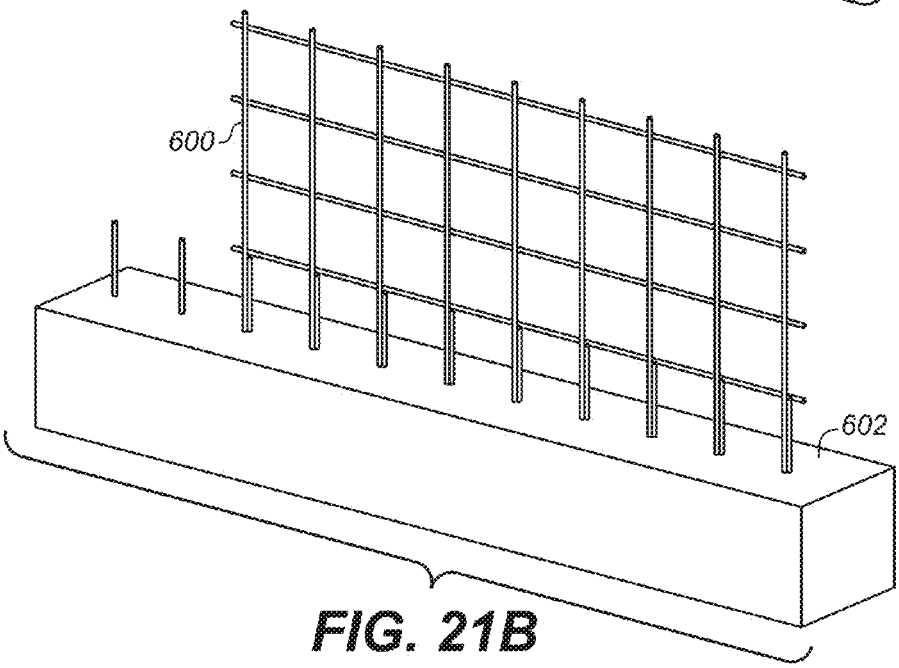
FIG. 21B shows the matrix installed in the concreted footing.
Figure 23:
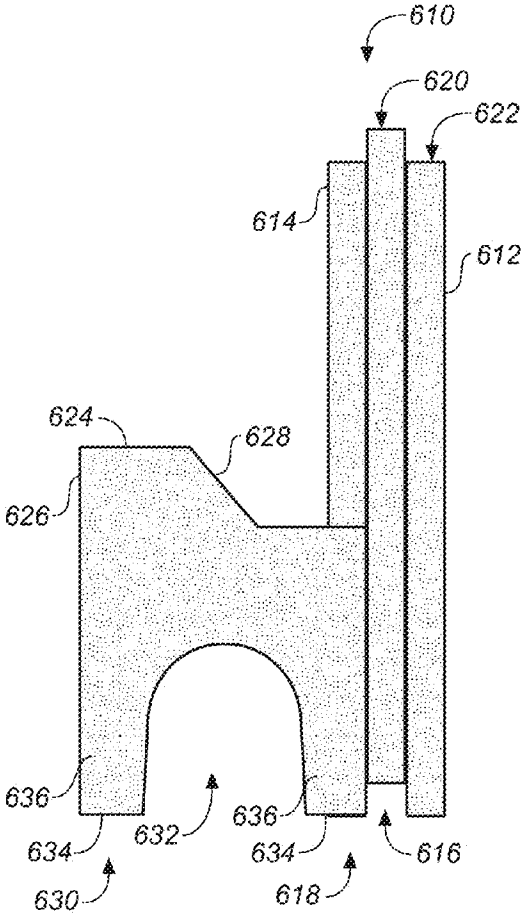
FIG. 23 is a left end view in elevation thereof.

FIGS. 21A and 21B shows how a pre-assembled structural steel matrix 600 can be embedded in and mounted onto a concrete footing 602 in a generally vertical plane so as to provide the framework or scaffolding through and around which the wall units of the inventive wall system can be assembled to make a complete and freestanding wall. The grid is here shown schematically to represent any of a number of possible materials, including steel reinforcement bar, rods, wire, rails, and so forth, and therefore the phrase "structural steel grid matrix" is understood to contemplate the various configurations and materials denoted by such terms. In each instance, however, it will be understood that the prefabricated or built-in-place grid matrix can be welded or tied together and is substantially uniform and symmetrical about both its horizontal and vertical axes, the vertical mains 604 and the horizontal members 606 being spaced, configured, and connected to form either generally square openings or generally rectangular openings.

FIG. 22-27 show a third preferred embodiment 610 of a wall unit in a single-unit-type system as used in the inventive system.

Figure 28:
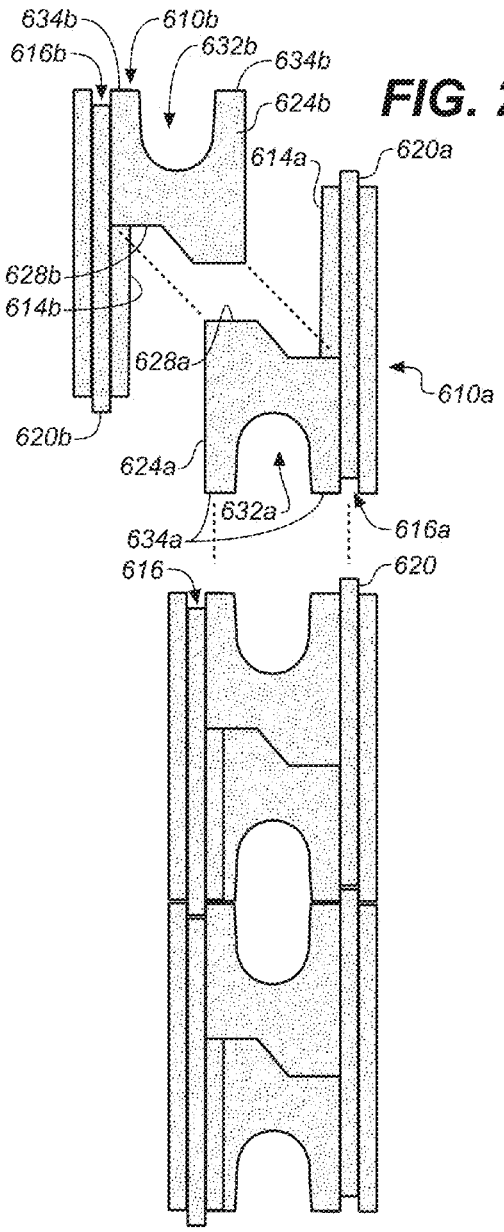
FIG. 28 is an end view in elevation showing the wall unit of FIGS. 22-27 in a stacked configuration, with the upper two wall units oriented and poised for placement atop two courses already in place.
Figure 30:
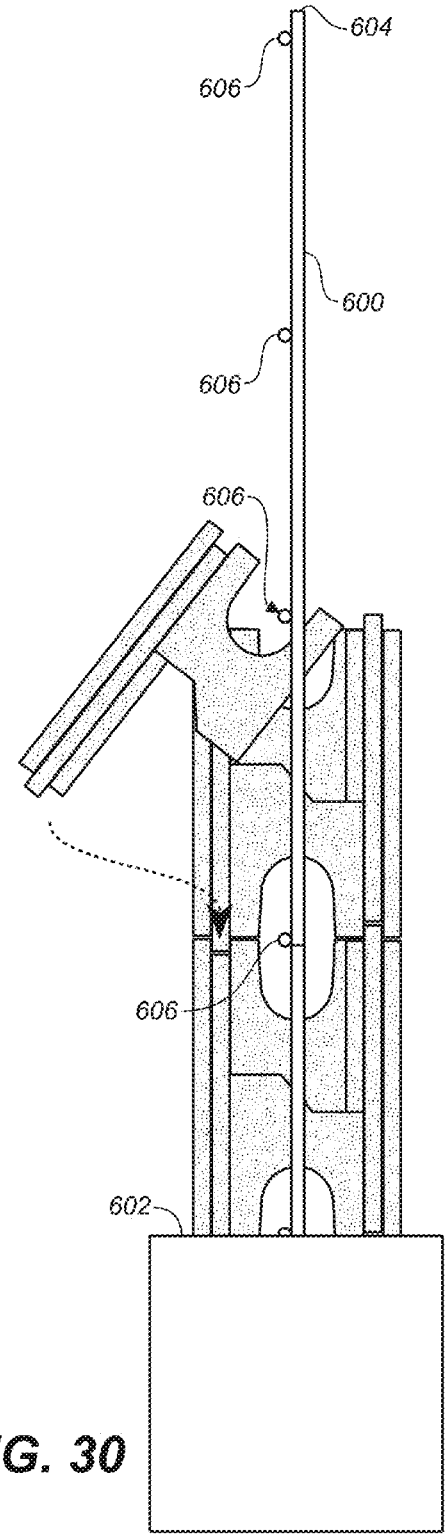
FIG. 30 is an end view in elevation thereof.
Figure 29:
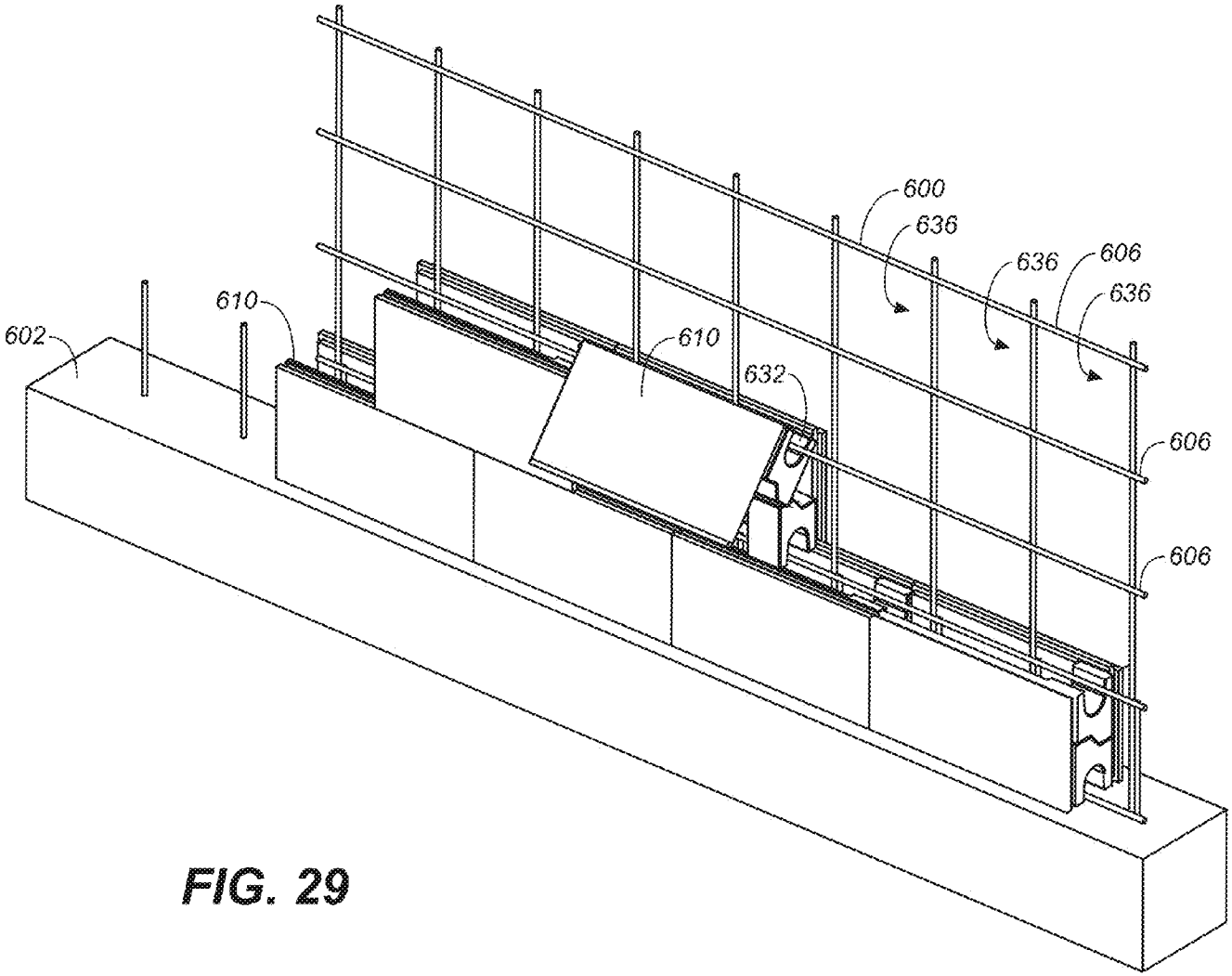
FIG. 29 is an upper perspective view showing how the wall unit of FIGS. 22-28 is installed in courses using a vertical rolling method on an in-place pre-fabricated structural steel grid matrix.

FIGS. 28-30 show how a single unit wall system using the unit 610 of FIGS. 22-27 is employed to lay courses in a stacked arrangement using a vertical rolling method (rotation about a horizontal axis of the wall unit, i.e., in a vertical plane), so as to provide a complete single-unit system for installation through and around an in-place prefabricated structural steel grid matrix 600. This wall unit includes a generally planar front side 612 (the "finish" side), a generally planar rear side 614, a groove portion 616 disposed longitudinally along the bottom side 618, a tongue portion 620 disposed longitudinally along the top side 622, and a male interlocking element 624 projecting rearwardly from the rear (or interior) side. The male interlocking element includes a planar back side 626 for placement flush against the back side of an opposing, identical wall unit, and a top side 628 configured with a surface geometry to create a puzzle-like interlocking fit with a complementary male interlocking element of an opposing wall unit. The bottom side 630 of the male interlocking element includes a round arch recess 632 with feet 634 on the lower end of each impost portion 636 defining the arch span. The feet stand upon the concrete foundation 602 (in the case of the lowest course) or engage the feet of a male interlocking element in a wall unit of a course of wall units immediately above or immediately below it.

Figure 22:
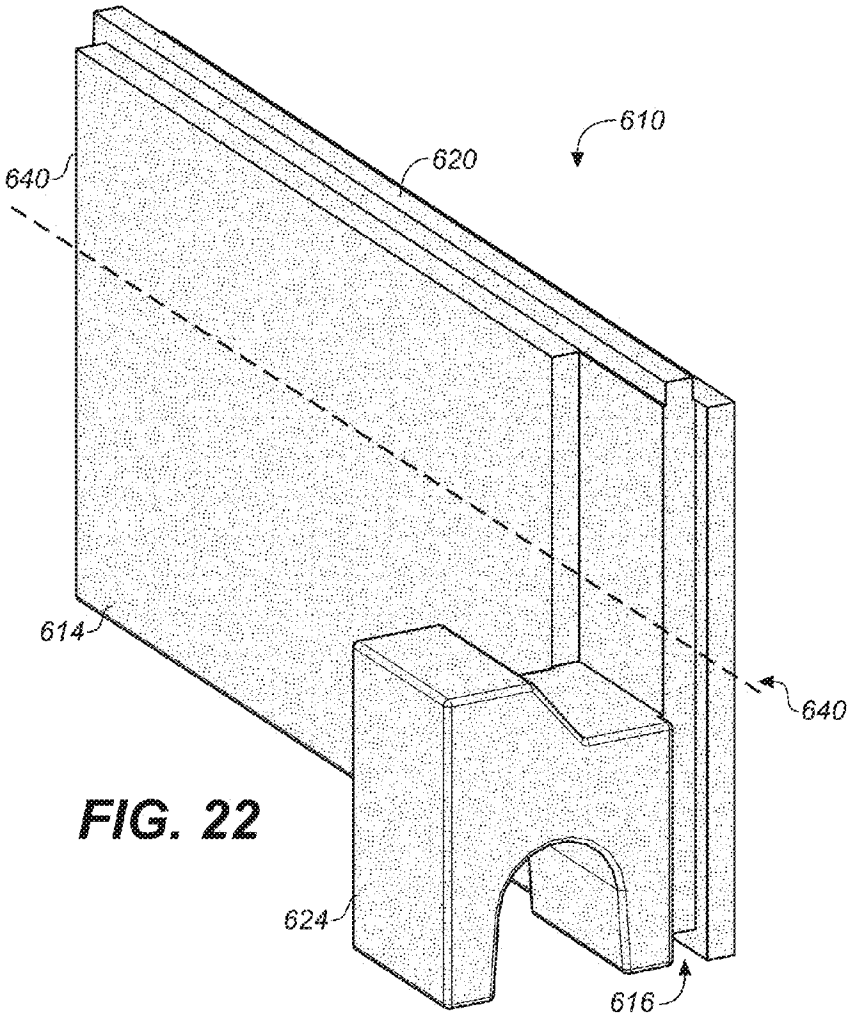
FIG. 22 is an upper left rear (interior) perspective view of a third preferred embodiment of an "over/under" single-unit-type wall unit used in the inventive system, showing the interlocking male element projecting rearwards from the inner face of the wall unit.
Figure 24:
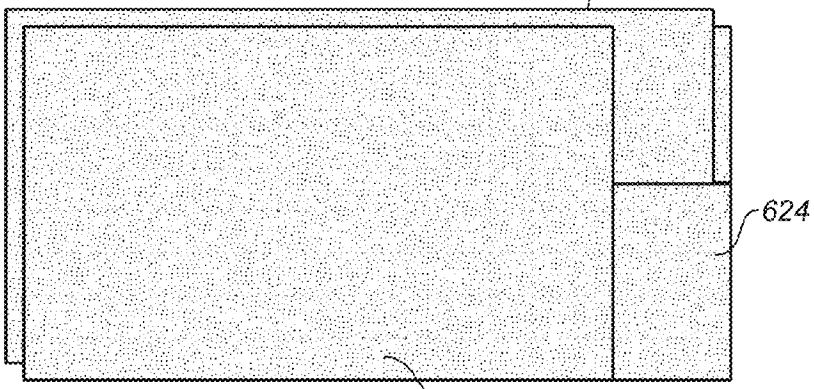
FIG. 24 is a rear (interior) side view in elevation thereof.
Figure 25:
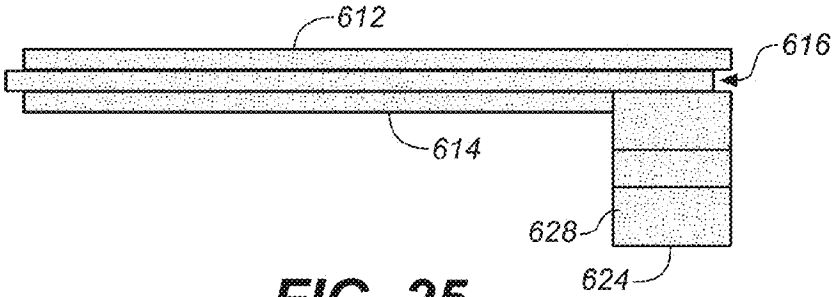
FIG. 25 is a top plan view thereof.
Figure 26:
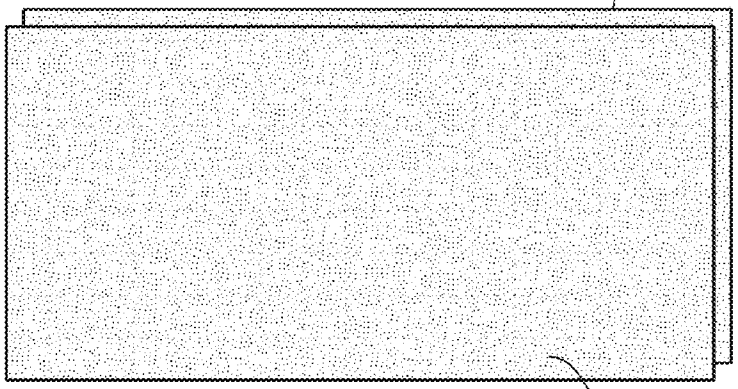
FIG. 26 is a front (exterior or "finish") side view in elevation thereof.
Figure 27:
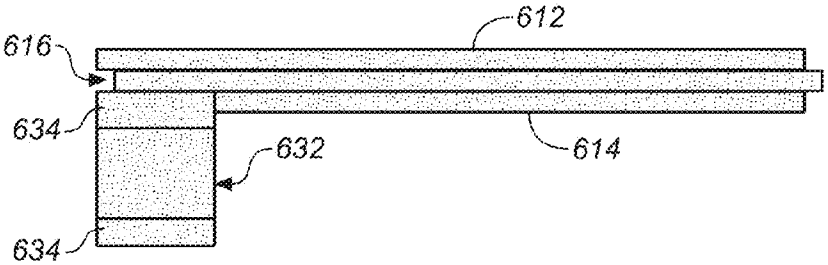
FIG. 27 is a bottom view thereof.

As shown in FIG. 28, an opposing wall unit is positioned by rotating a second wall unit 610*b* in relation to a first wall unit 610*a* about a horizontal axis 640 of the wall unit (this latter element shown on FIG. 22). This rotation, in a vertical plane, places the rear side 614*b* of the second wall unit 610*b* in a generally parallel opposing relationship with the rear side 614*a* of the first wall unit 610*a*, and it inverts the male interlocking element 624*b* in relation to the opposing male interlocking element 624*a*. The tongue elements 620*a*, 620*b* insert into groove elements 616*a*, 616*b*, of wall units above and below, respectively; and the feet 634*a*, 634*b*, engage feet in wall units below and above, respectively. At the same time, and as seen in FIGS. 29 and 30, the round arches 632*a*, 632*b*, permit insertion through an opening in the prefabricated and pre-installed structural steel grid matrix and rotation over and under, respectively, a horizontal cross member 606, so that the wall unit can be placed into an interlocking relationship with a complementary opposing relationship with an identical wall unit on the opposite side of the matrix.

Figure 33:
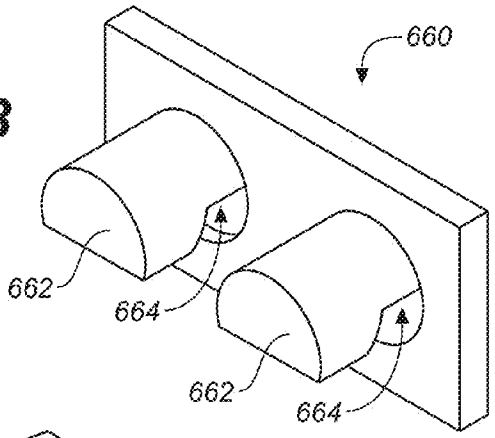
FIGS. 31-33 are each upper left rear (interior) perspective views of fourth, fifth, and sixth preferred embodiments of the inventive wall unit units, each adapted for use in single wall unit interlocking system, with FIG. 34 being an upper left rear perspective view of the first preferred embodiment, shown in FIGS. 5-10 presented nearby to facilitate an appreciation of the features shared by the wall units comprising the single unit interlocking system.
Figure 34:
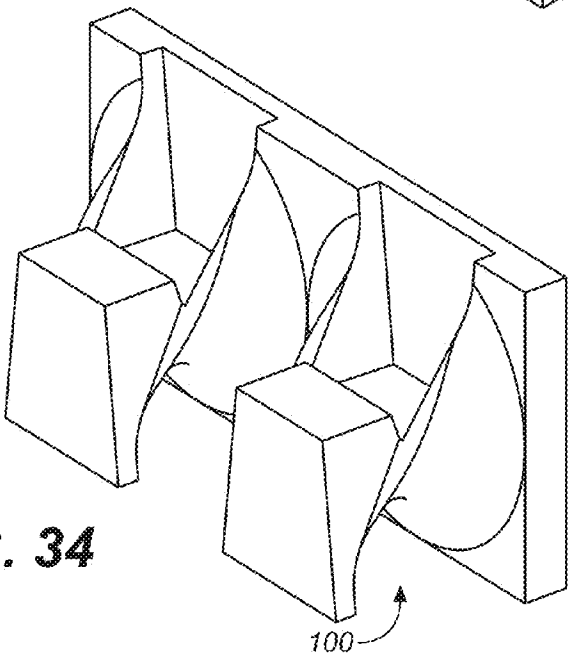
Figure 31:
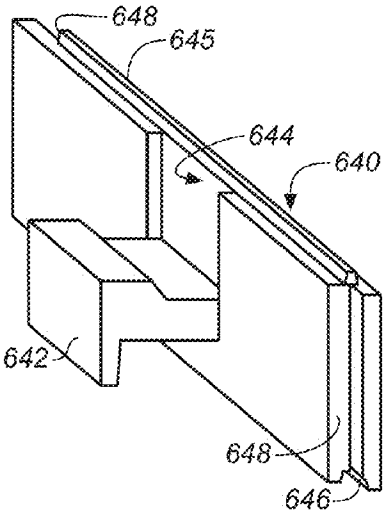
Figure 32:
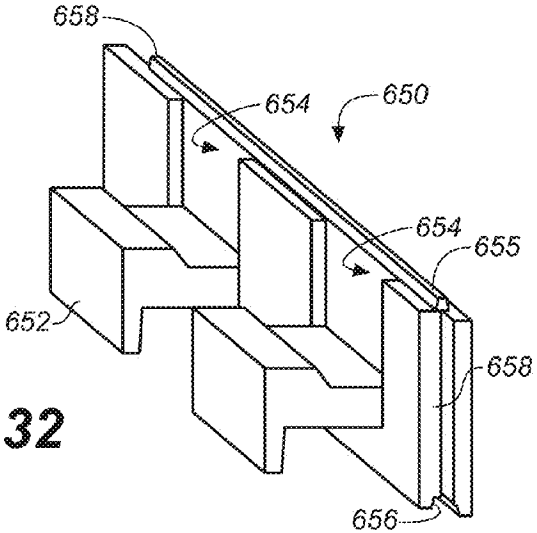

Referring next to FIGS. 31-33, there are shown fourth through sixth preferred embodiments of the inventive wall unit, 640, 650, 660, respectively, each being variations on the single-unit interlocking designs capable of functioning in the above-described manner. FIG. 34 is presented as a reminder of the first preferred embodiment 100, shown in FIGS. 5-10, so as to 5 facilitate an appreciation of the features shared by the wall units comprising the single unit interlocking system. It will be seen by reference to these drawings that the single-unit wall units include one or more male interlocking elements 642, 652, 662, and female recess portions 644, 654, 664, that each include features that are brought into a complementary interlocking arrangement by rotating a second, identical wall unit about its horizontal axis, inverting it in 10 relation to a first wall unit, thereby positioning the male interlocking elements and female recess portions into a structurally complementary orientation, wherein approximating the wall units and inserting the male elements into the female recesses brings the interlocking structures into engagement and prevents migration or translation of the wall units apart from one another. This interlocking engagement can be supplemented and enhanced by providing tongue-and-groove 15 features 645, 646, and 655, 656, on the upper and lower sides of the wall units, as well as rabbetting 648, 658 on the sides (see FIGS. 31, 32), so that outward movement of the wall units is further prohibited by adjoining wall units. In the alternative (FIGS. 33 and 34), the upper and lower edges can be generally flat.

Figure 35:
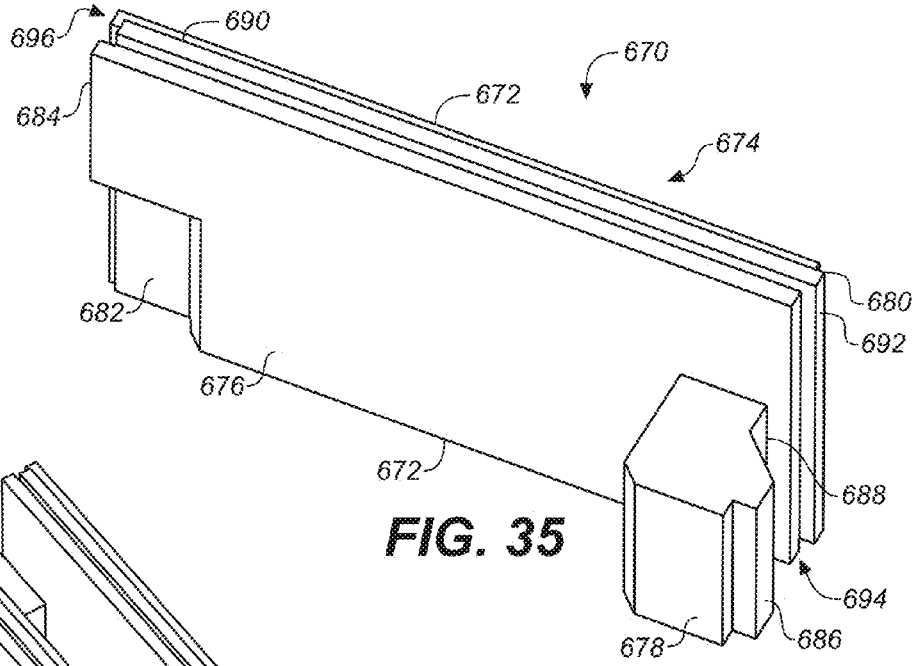
FIG. 35 is an upper left rear perspective view showing a seventh preferred embodiment of the wall unit of the present invention, in which the wall unit is rotated about its vertical axis to bring the interlocking elements into the proper orientation for making an interlocking connection with an opposing wall unit.

FIG. 35 shows a seventh preferred embodiment 670 of the single unit design wall unit of the present invention. In this embodiment, the wall unit is rotated about its vertical axis 672 to bring the interlocking elements into the proper orientation for making an interlocking connection with an opposing, identical wall unit. This is accomplished by providing a wall unit having a generally planar front (exterior) side 674, a generally planar rear (interior) side 676, a single male interlocking element 678 positioned more proximate a first end 680 of the wall unit, and a complementary female recess 682 in the rear side and proximate the second end 684. The male interlocking element notably includes a convex portion 686 and a concave portion 688, such that when the wall unit is rotated about its vertical axis 672 and the units generally approximated, the male interlocking element is positioned not only for insertion into the female element, but into interlocking relationship with a male element in an opposing, identical wall unit in an adjoining pair of opposing wall units in the same course (see FIG. 36). Once again, the wall unit may include top and end tongue and groove elements 690, 692, 694, 696, to further enhance the structural integrity of the assembled structure.

Figure 36:
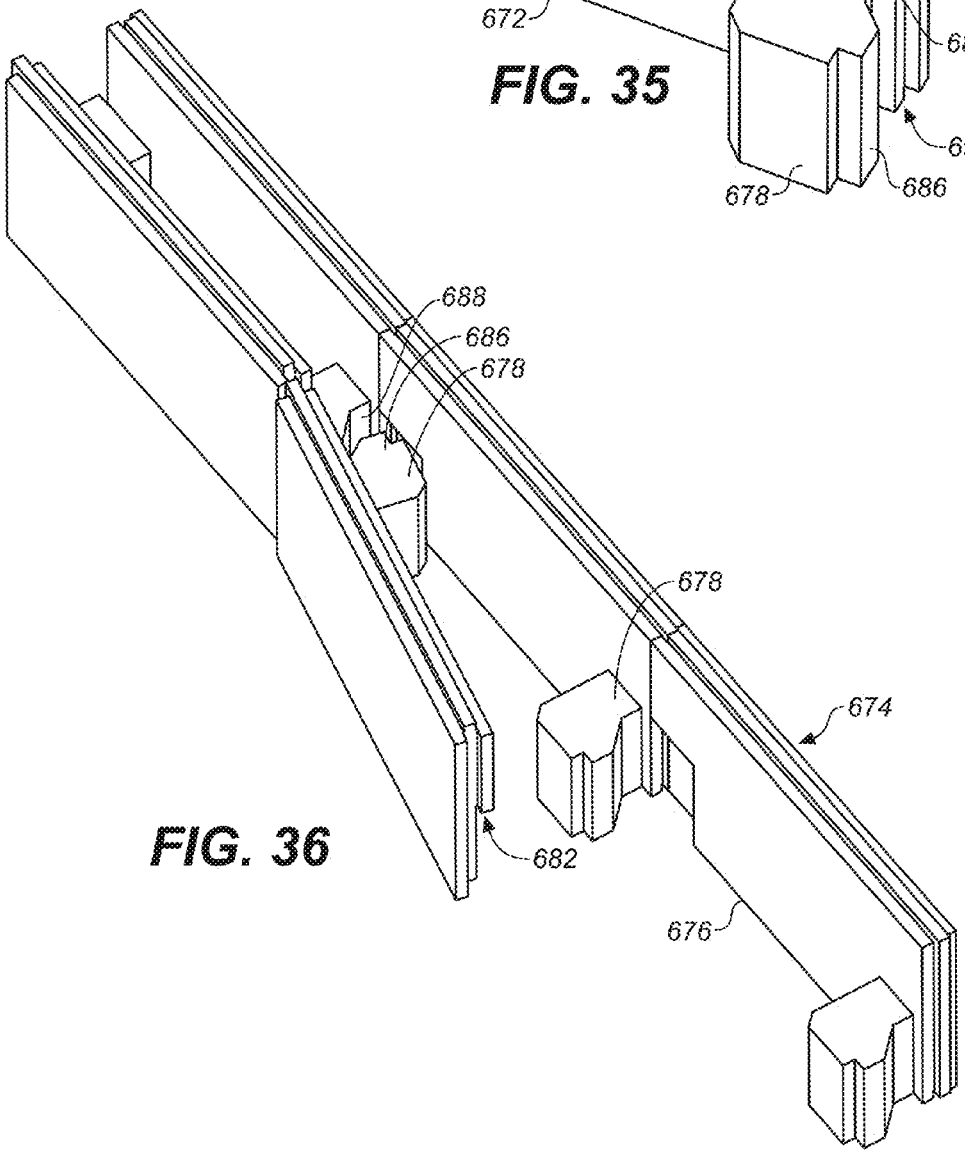
FIG. 36 is an upper perspective view showing how the single-unit-type wall units of FIG. 35 are aligned and positioned in a wall under assembly.
Figure 37:
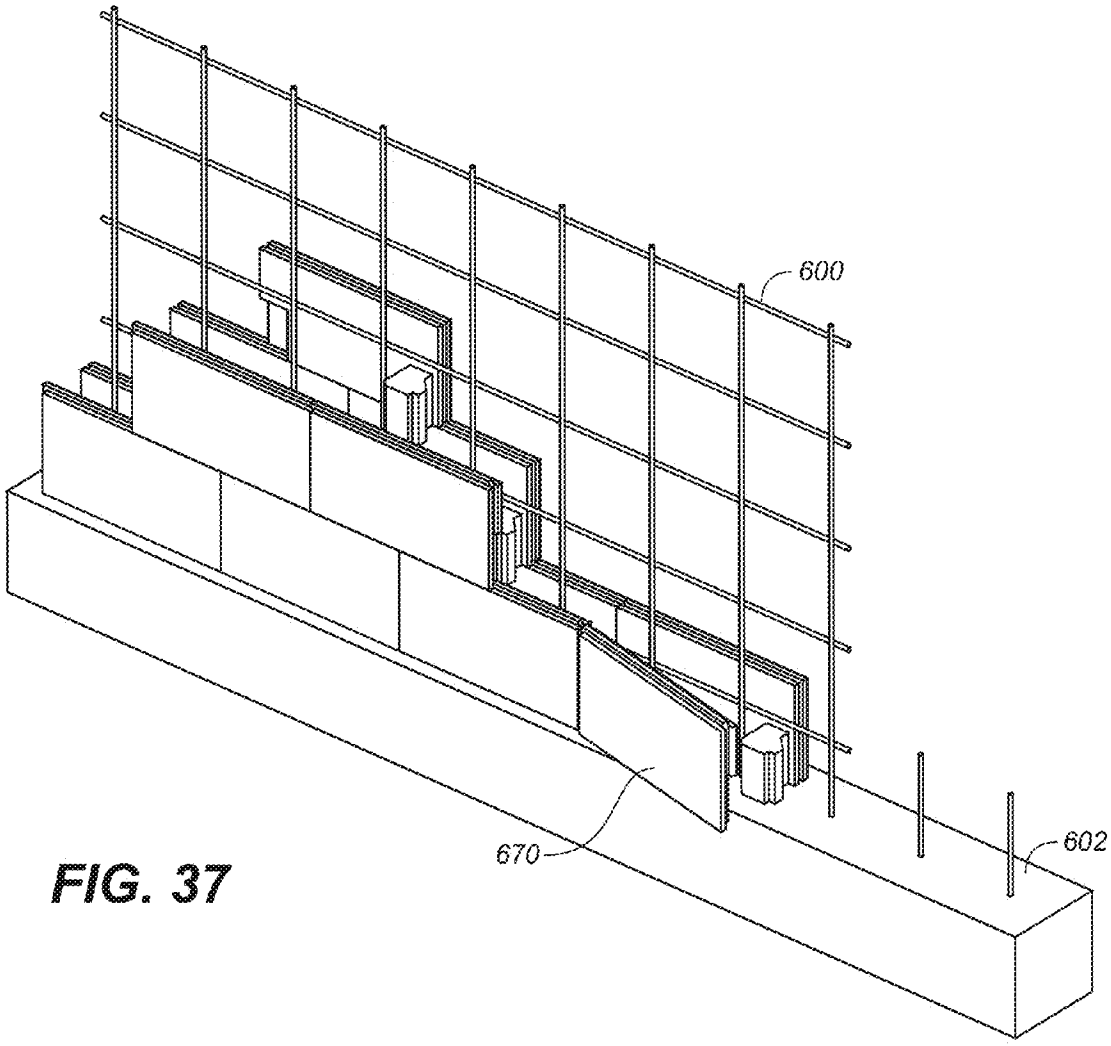
FIG. 37 is an upper perspective view showing how the wall unit of FIG. 35 is used to assemble a wall on (through and around) a pre-existing structural grid matrix.

FIG. 37 shows how the wall unit of FIGS. 35 and 36 is used to assemble a wall on a vertically oriented pre-installed and prefabricated structural steel grid matrix 600.

It bears mention that in each of the foregoing embodiments, while the assembly of a freestanding wall about a pre-existing structural steel grid matrix takes place on both sides of the grid matrix, the assembly itself can be accomplished with the worker(s) remaining on only one side of the developing wall. The wall units are simply rotated into the proper orientation on the worker's side of the matrix, passed through an available opening in the matrix to the opposite side of the matrix, and then brought into the interlocking position with a wall unit on the worker's side in the course being laid. Furthermore, plumbing and electrical wiring can be incorporated into the structural wall and onto the structural framework provided by the pre-installed matrix before the wall units are assembled.

Figure 38:
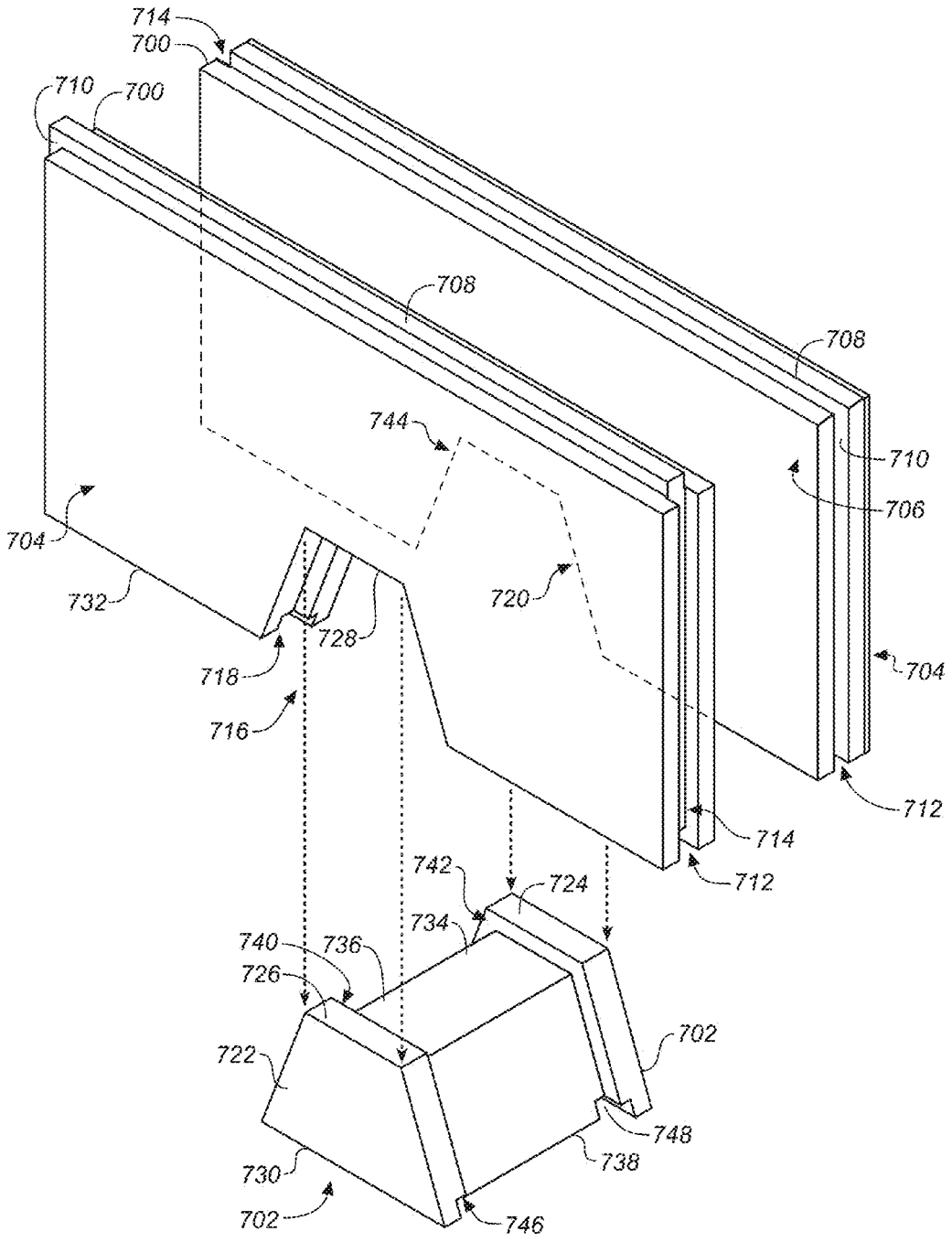
FIG. 38 is a perspective view showing an eighth preferred embodiment of the wall unit of the present invention, the first example of a unit forming part of a multi-unit system, with two of such identical wall units positioned in an opposing relationship and poised above an interlock unit employed to connect the wall units.

FIG. 38 is a perspective view showing two instances of an eighth preferred embodiment 700 of the wall unit of the present invention, this being the first example of a unit forming part of a multi-unit system. The front unit is rendered transparent so as to reveal and feature important functional elements in the rear unit. The two identical wall units are positioned in an opposing relationship and poised above a crossover connecting unit 702 employed to connect the wall units. The wall unit includes a front (exterior) side 704, a rear (interior) side 706, a top side tongue 708, a first end tongue 710, a bottom side groove 712, a second end groove 714, and a medial recess 716 having an outer portion 718 with a first depth, and an inner portion 720 with a slightly shallower depth. The crossover connecting unit 702 includes first and second ends 722, 724, shaped and sized to conform to the outer portion of the medial recess, such that the upper edge 726 of the crossover connecting unit end engages the upper portion 728 of the medial recess, while the lower edge 730 of the crossover connecting unit is generally coplanar with the bottom side 732 of the wall unit on assembly. The crossover connecting unit further includes a medial portion 734 that spans the distance between the two wall units, and includes an upper shelf 736 that sits at a level below the upper edge 726, and sides 738 that set in from the interior sides 740, 742 of the crossover connecting unit ends so as to create a flange that engages the step down 744 where the outer portion 718 of the medial recess 716 transitions to the inner portion 720. Finally, the crossover connecting unit 702 includes front and rear channels 746, 748 that line up with the groove 712 on the lower edge of the wall unit when assembled and are therefore also captured by the tongue elements from two abutting and underlying wall units.

Figure 39:
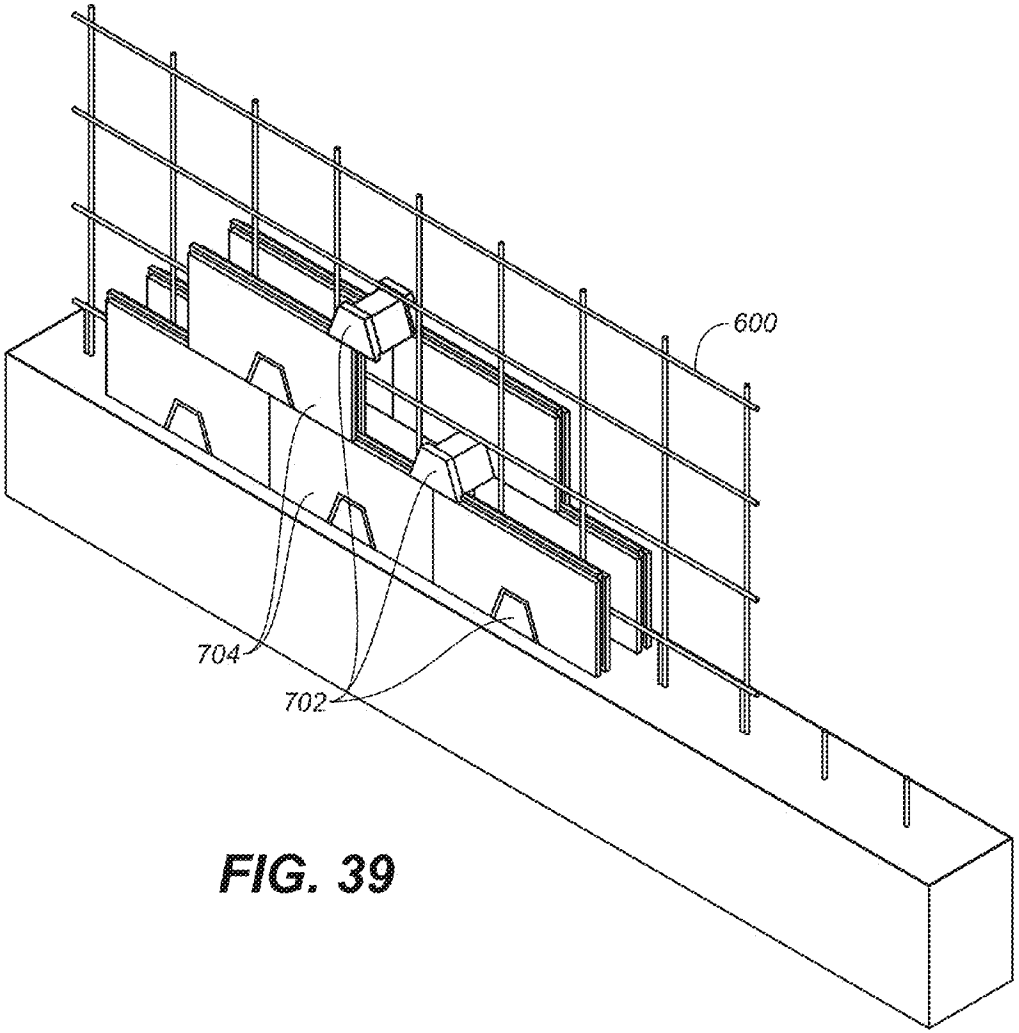
FIG. 39 is an upper perspective view showing how the wall units of FIG. 38 is assembled through and around a pre-existing structural steel grid matrix.

FIG. 39 is an upper perspective view showing how the wall unit of FIG. 38 is assembled through and around a pre-existing structural steel grid matrix 600. This view shows how the connecting units span the space between wall units to engage the connecting unit edges and so retain the wall units in the spaced apart opposing relationship, and also shows how the ends become co-planar with and blend into the front sides of each of the opposing, identical wall unit.

Figure 40:
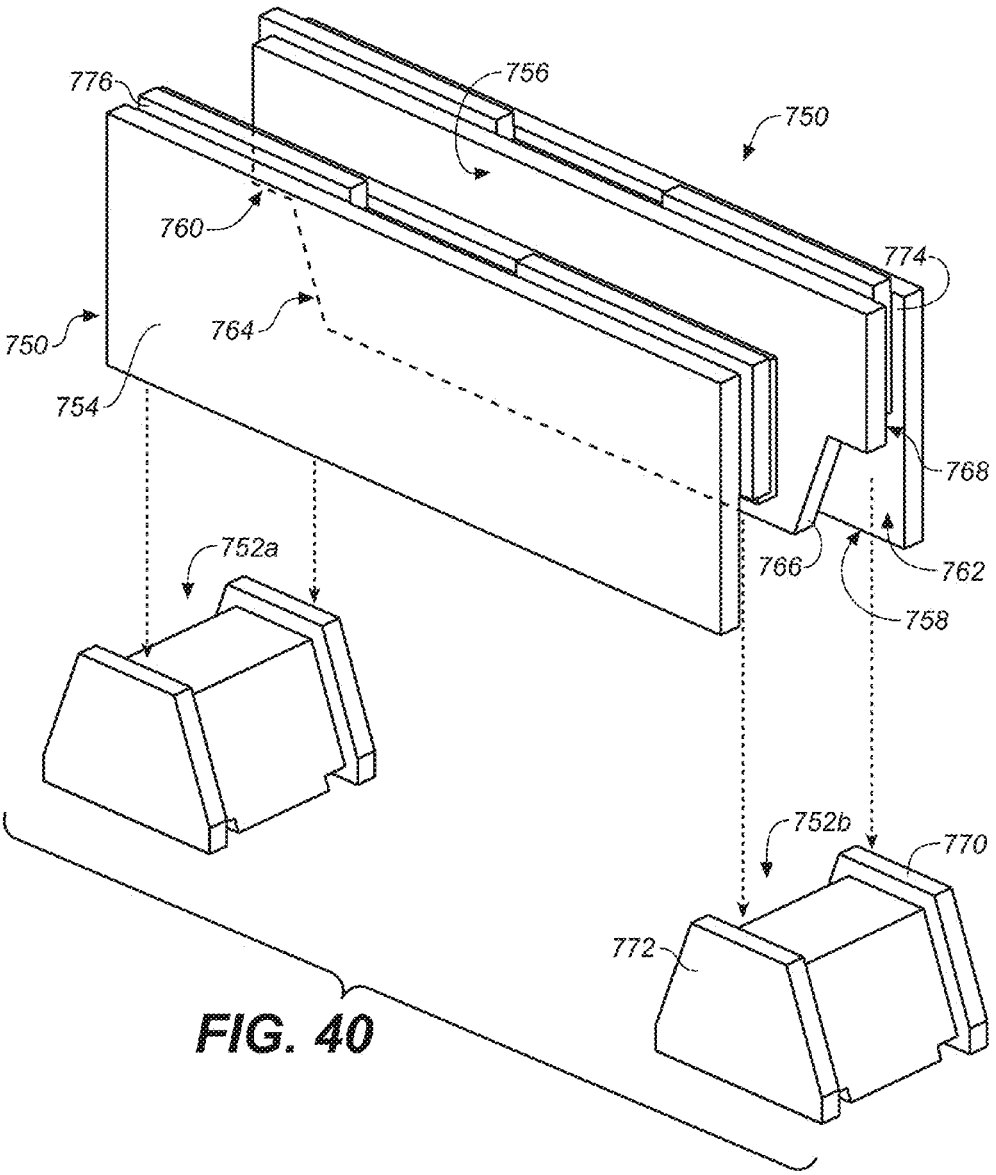
FIG. 40 is an upper perspective view showing a ninth preferred embodiment of the wall unit of the present invention, with opposing identical wall units poised for placement over a pair of cross-over interlock units, the wall unit configured in such a way that the interlock units are concealed on assembly.
Figure 41:
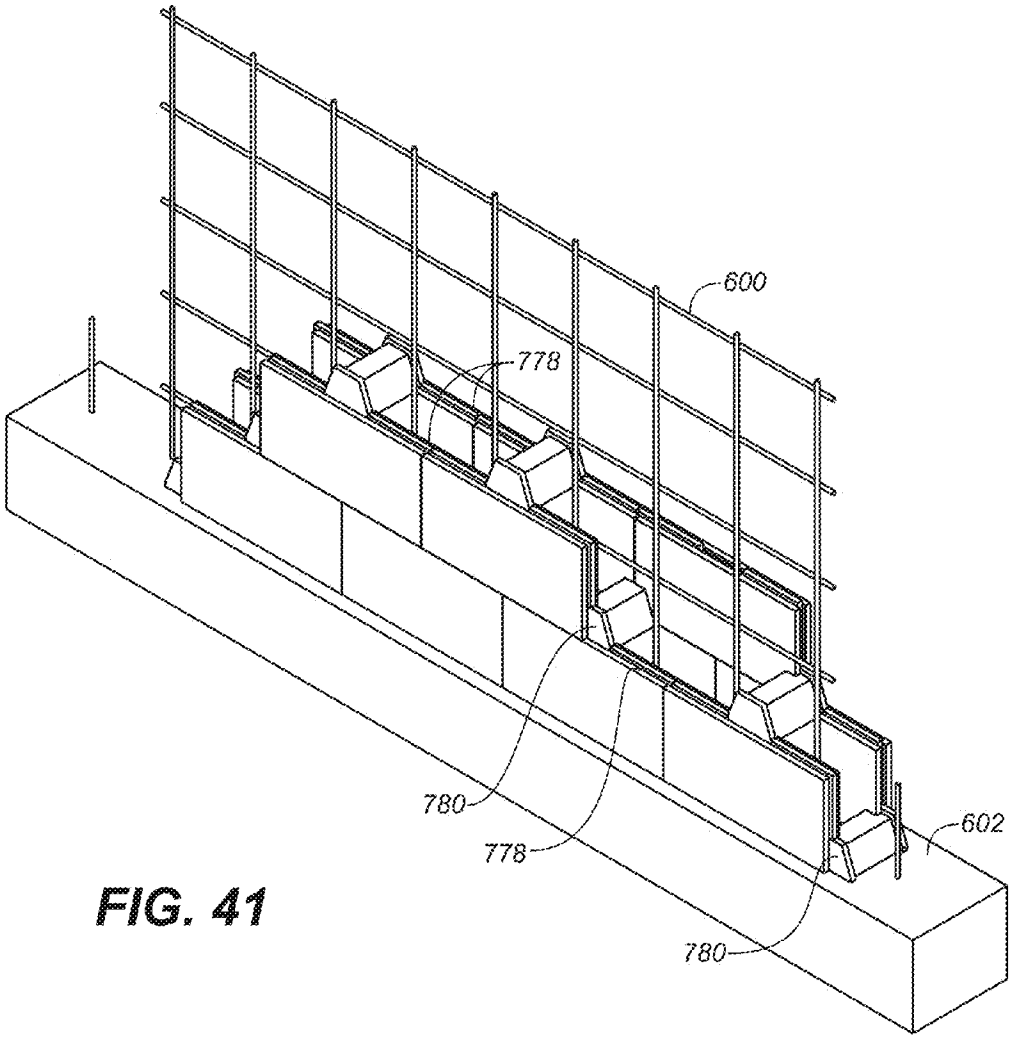
FIG. 41 is an upper perspective view showing a wall during assembly using the wall unit of FIG. 40.

FIG. 40 shows a ninth preferred embodiment 750 of the multi-unit wall system of the present invention, with opposing wall units poised for placement onto a pair of cross-over connecting units 752*a*, 752*b*, which span the grid matrix and provide sufficient spacing between the wall units for void fill material. The wall unit is configured in such a way that the interlock connecting units are entirely concealed on assembly. The wall unit includes a generally planar front side 754 and a generally planar rear side 756, with no integral interlock member. The cross-over connecting unit 752*a*, 752*b* employed to connect the opposing panels is structurally similar to the connecting unit for the eighth preferred embodiment and works in a similar manner. However, the wall unit includes first and second recess portions, 758, 760 on each of its lower corners 762, 764, the recess sized with a retaining edge 766 and a channel 768 to accommodate half the exterior dimension of one of two ends 770, 772 of the connecting unit. The end slips into the channel and is held by the retaining edge, but the ends of the connecting unit are entirely concealed behind the wall unit lower corner. The wall units also include tongue and groove portions 774, 776, surrounding the entire unit so that tongue and groove connections 778 are formed with adjoining wall units in the same course and with courses above and below. The concealed connecting unit 780 and tongue and groove portions 778 are shown clearly in FIG. 41.

Figure 42:
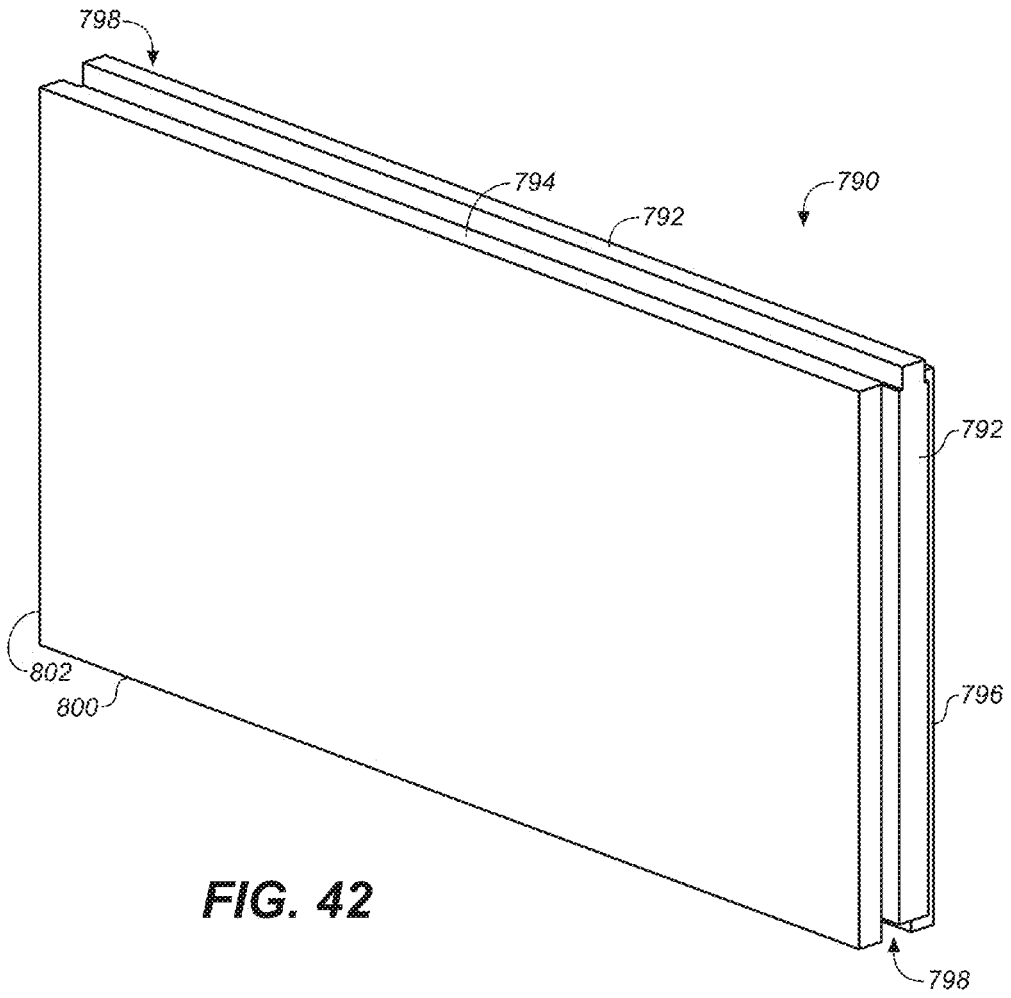
FIG. 42 is an upper perspective view showing a tenth preferred embodiment of a bracket-assisted wall unit of the present invention, this being a simple planar tongue-and-groove configuration.

FIG. 42 shows a tenth preferred embodiment 790 of the wall unit of the present invention. Perhaps the simplest of the wall units of the present invention, this wall unit is part of a cross-over bracket-assisted system and includes a generally planar block having a tongue portion 792 extending along substantially the length of a top edge 794 and a first end 796, and a groove portion 798 extending along substantially the length of the bottom edge 800 and a second end 802.

Figure 43:
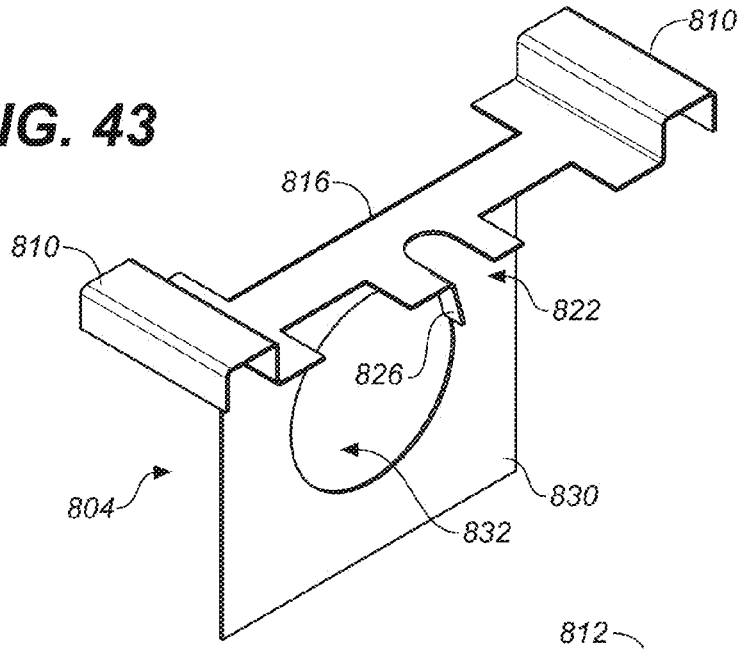
FIGS. 43-45 are upper perspective views showing three different brackets that can be used individually or collectively with the wall unit shown in FIG. 45 to assemble a wall through and around a pre-existing structural steel grid matrix.
Figure 44:
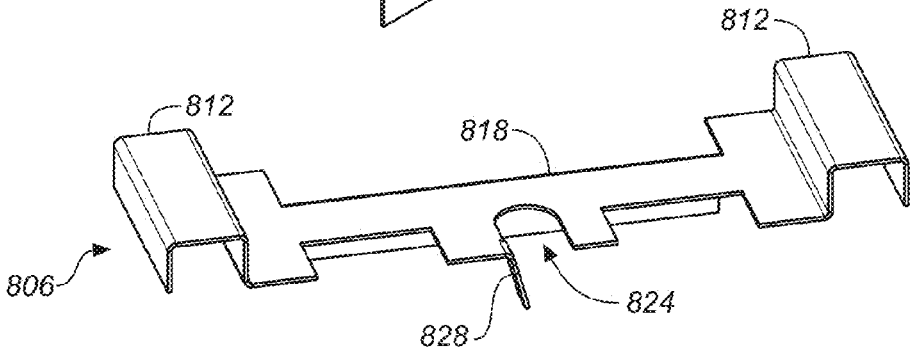
Figure 45:
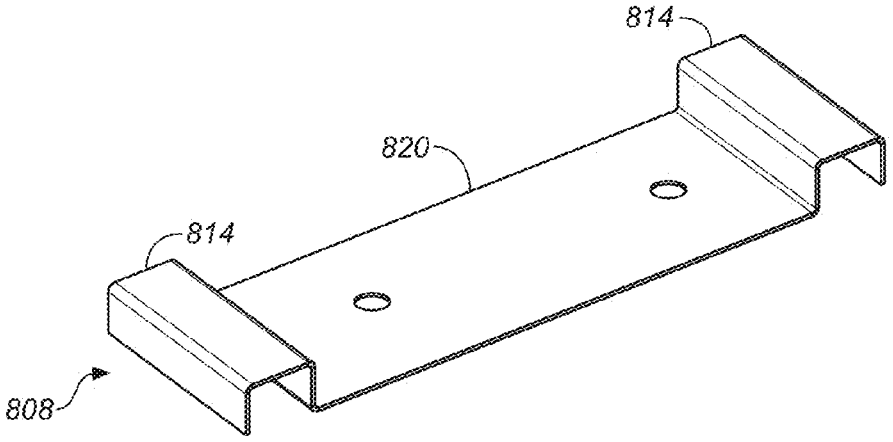
Figure 46:
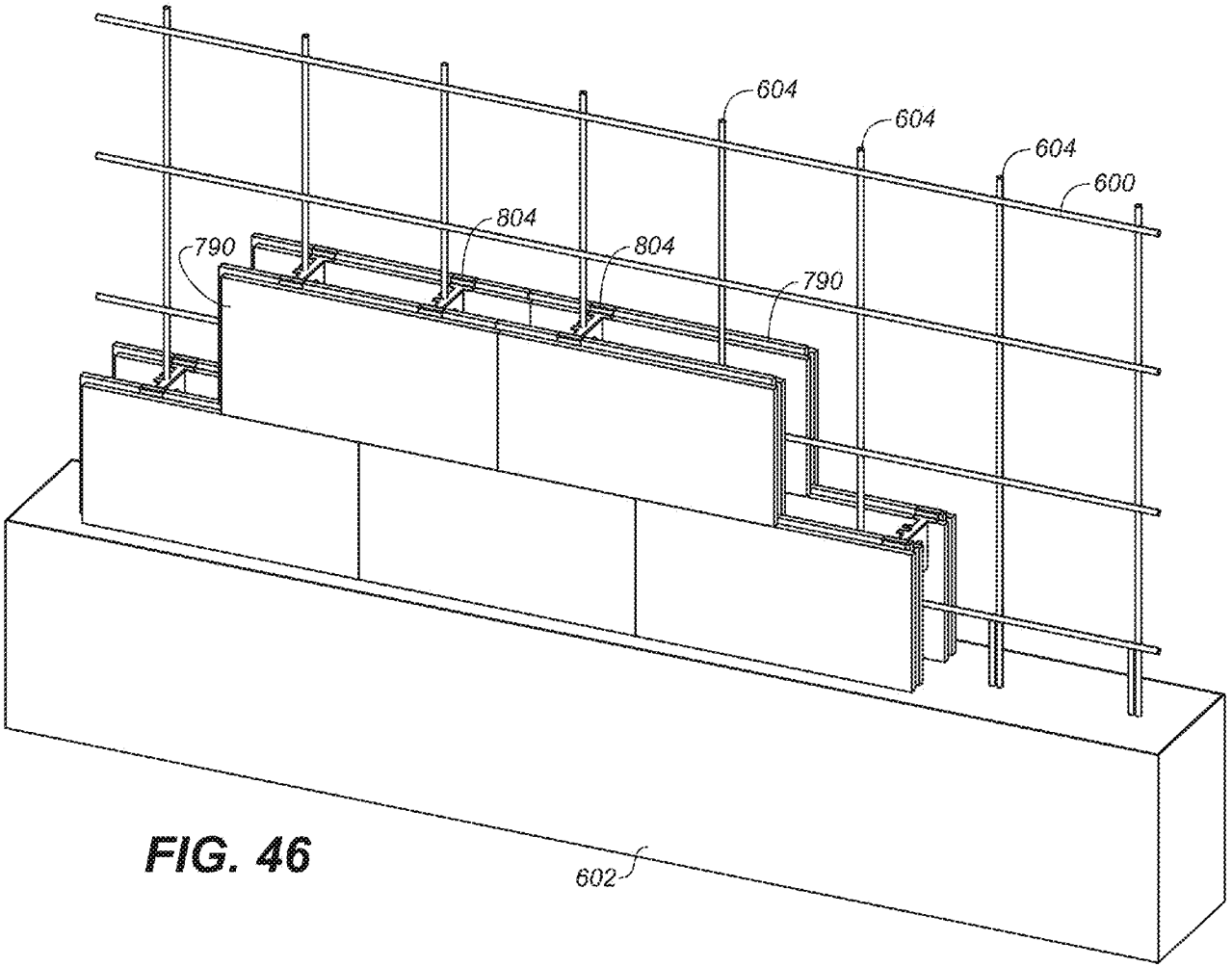
FIG. 46 is an upper perspective view showing a wall under assembly using the bracket-assisted wall unit of FIG. 42 and the cross-over interlock brackets of FIG. 43.

FIGS. 43-45 show three novel cross-over interlock brackets 804, 806, 808, that can be used individually or collectively with the wall unit of FIG. 45. Each bracket includes end channels 810, 812, 814, which are placed over the tongue portion of the upper edge of wall unit 790 (see FIG. 46). The medial spans 816, 818, 820 differ according to function, the latter span 820 being a simple panel to effect a mechanical connection between opposing wall units and it is thus adapted for primary use as a "starter" bracket, with holes for fastening the bracket to a substrate using concrete screws or concrete nails. This bracket is designed so that shims can be placed under the channels for leveling a first course of wall units. It may also be employed to hold panels in place as other elements are positioned and placed before placement of final containment brackets. Medial spans 816 and 818 further include a recess 822, 824 to accommodate a vertical main 604 of the grid matrix 600. An angled tab 826, 828 can be disposed on a side of the recess to stabilize and secure the bracket on the vertical main. These brackets may, accordingly, be considered "rebar brackets." Finally, bracket 804 can be provided with a vertically disposed plate 830 to provide diagonal sheer strength before the wall is filled with structural void fill material. The vertical plate thus includes an aperture 832 or a knock out to facilitate the free flow of the void fill. The brackets of FIGS. 43-45 are preferably fabricated from galvanized sheet metal, though stainless steel or other suitably sturdy materials may be employed.

Figure 47:
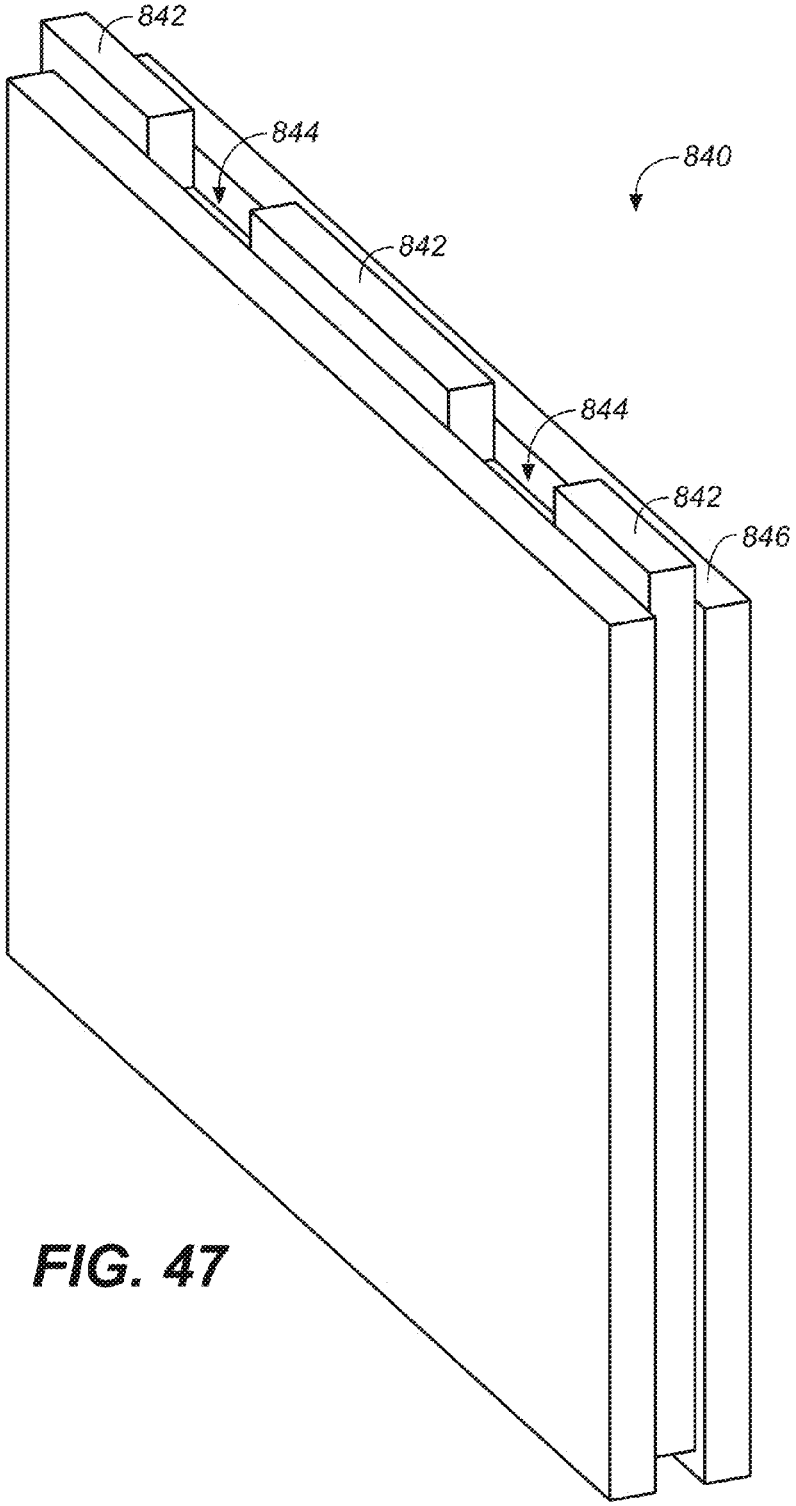
FIG. 47 shows yet another, eleventh, preferred embodiment, forming part of an alternative bracket-assisted system, this embodiment including discontinuous tongue elements on the upper edge of the planar wall unit so as to provide gaps for concealed brackets (shown in FIGS. 48-51) to be placed.
Figure 48:
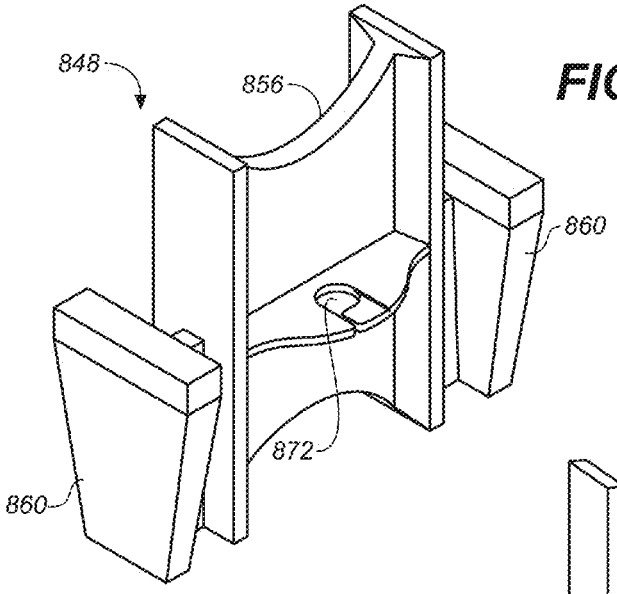
FIGS. 48-51 are each upper perspective views showing possible bracket configurations for use with the wall unit of FIG. 47.
Figure 49:
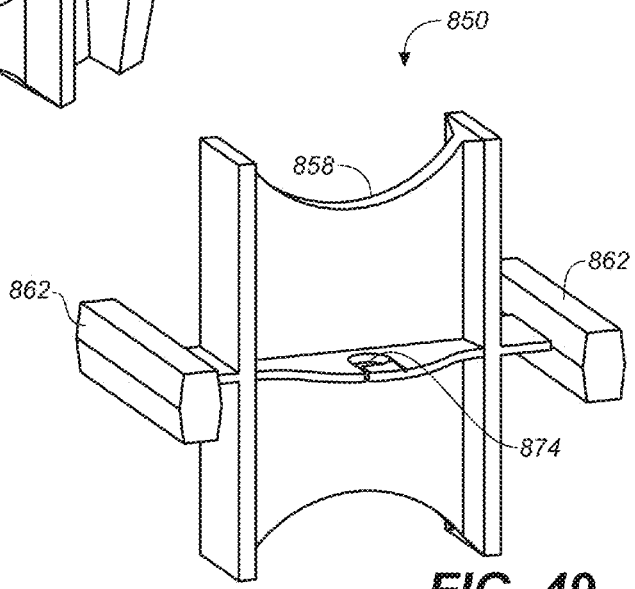
Figure 50:
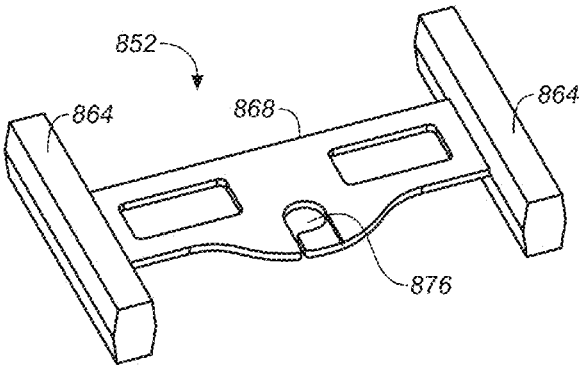
Figure 51:
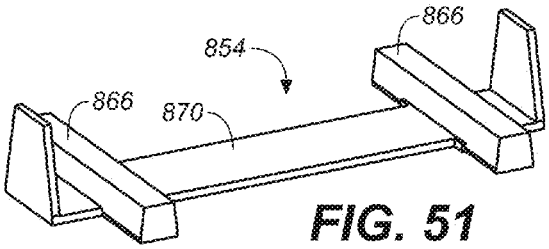
Figure 52:
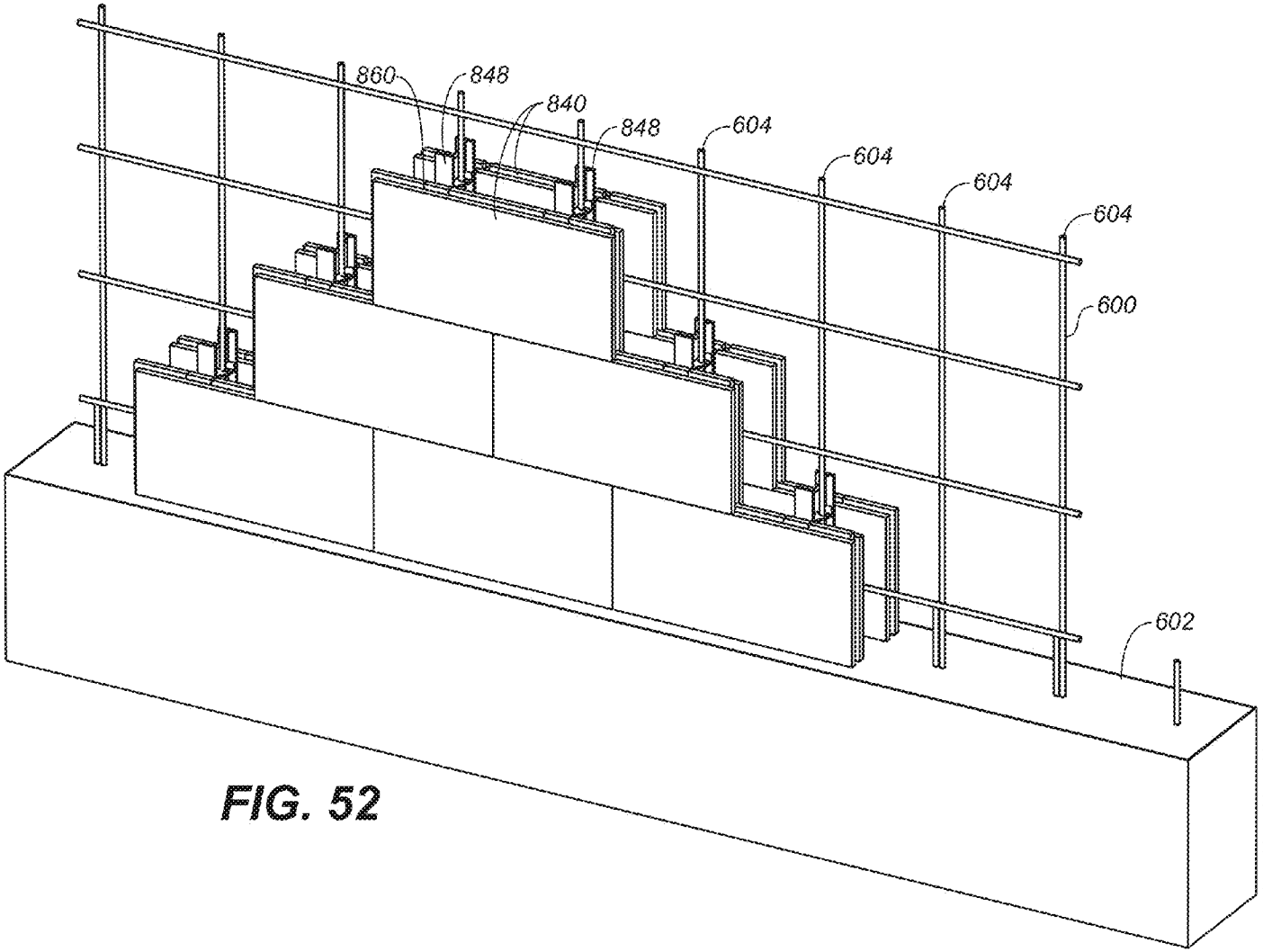
FIG. 52 is an upper perspective view of a wall under assembly using the wall unit of FIG. 47 and the bracket of FIG. 48.

FIG. 47 shows yet another, eleventh, preferred embodiment, 840, of a wall unit of the present invention, this embodiment again forming part of a cross-over interlock bracket-assisted system. This wall unit is a variation on the generally planar unit of FIG. 42, and also includes a tongue element on the top edge and a first end, as well as a groove on the bottom edge and a second end, wherein the tongue element 842 is discontinuous on the top edge and includes one or more gaps 844 that open to recesses extending below the level 846 of the edge itself. FIGS. 48-50 show various cross-over interlock brackets 848, 850, 852, 854, that can be used with the wall unit of FIG. 47. Brackets 848 and 850 include an I-beam type body 856, 858 with shoulders 860, 862 extending outwardly from the body to provide elements for insertion into the recesses formed by the gaps 844 in the tongue element of a wall unit onto which it is placed as well as the groove portion of a wall unit immediately above it. In this manner, the bracket retains wall units both above and below in the proper spaced-apart position and provides diagonal sheer strength to the opposing units and collective stability to the form wall before it is filled with void fill material. Bracket 852, and starter bracket 854 also include shoulders 864, 866 for such use, though they are simpler in design and include only a generally flat medial panel 868, 870 spanning the distance between shoulders. The first three of the brackets also include a recess 872, 874, 876 for capturing a vertical main 604 in a prefabricated pre-installed structural steel grid matrix 600 (as is shown in FIG. 52). It will be appreciated that the shoulders of each bracket insert into gaps in the middle of the wall unit panel, and they are therefore entirely concealed on assembly. It will also be appreciated that the brackets can be fabricated from a number of suitable materials, though fabrication using plastic injection molding is preferable for these bracket designs.

Figure 53:
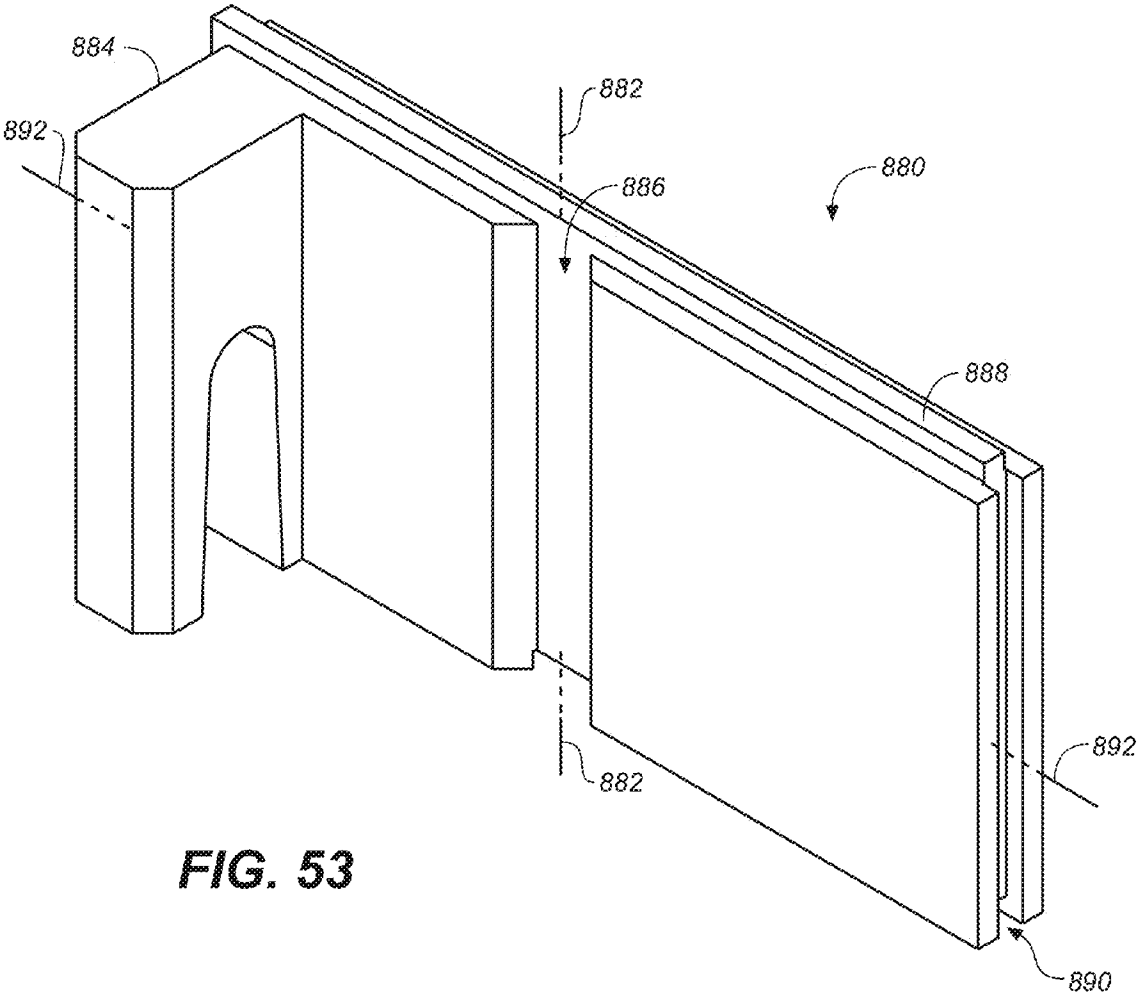
FIG. 53 is an upper rear (interior) side perspective view of a twelfth preferred embodiment of a wall unit of the present invention, again comprising part of a bracket-assisted system, the unit for rotation about a vertical axis (rotation on a horizontal plane) to bring a male member of one wall unit into alignment for connection with a female element in an opposing panel.
Figure 54:
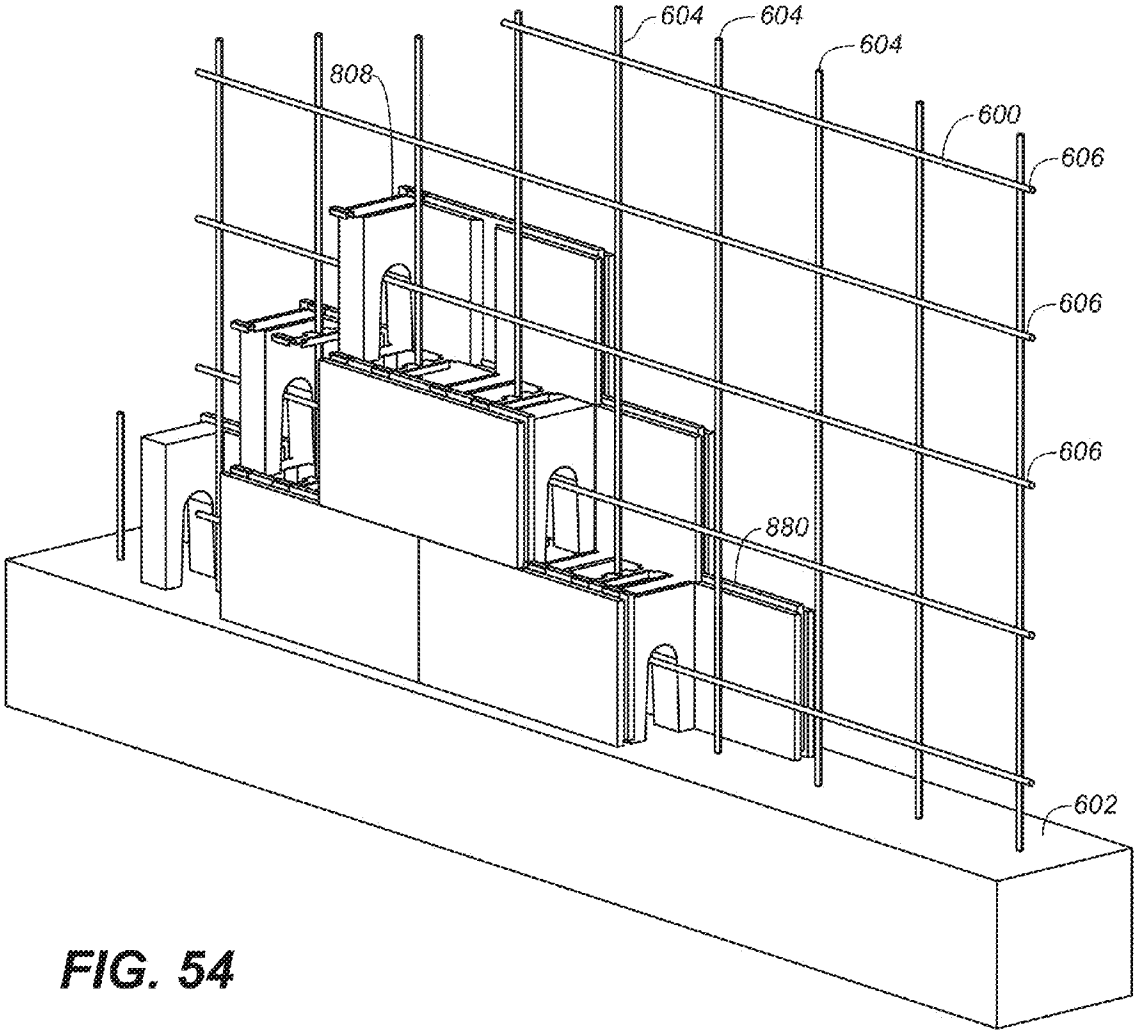
FIG. 54 is an upper perspective view showing a wall under assembly using the wall unit of FIG. 53 and the bracket of FIG. 45.

FIG. 53 shows a twelfth preferred embodiment 880 of a wall unit of the present invention, again comprising part of a bracket-assisted system, the unit for rotation about a vertical axis 882 (rotation on a horizontal plane) to bring a male member 884 of one wall unit into alignment for connection with a female recess 886 in an offset (stagger stacked) opposing panel (the stacking regimen shown in FIG. 54). Tongue-and-groove elements 888, 890, further matingly connect and cooperate to provide increased stability and resistance to separation. As with the third preferred embodiment (FIGS. 22-27), the male element includes a rounded arch to facilitate rotation about the horizontal axis 892 of the wall unit as it is placed over and around horizontal cross members 606 of the grid matrix 600. Starter bracket 808 may be used as a containment bracket over the partition, though brackets 804 and 806 (FIGS. 43-44) may also be used to engage and capture the vertical mains 604 of the grid matrix.

Figure 55:
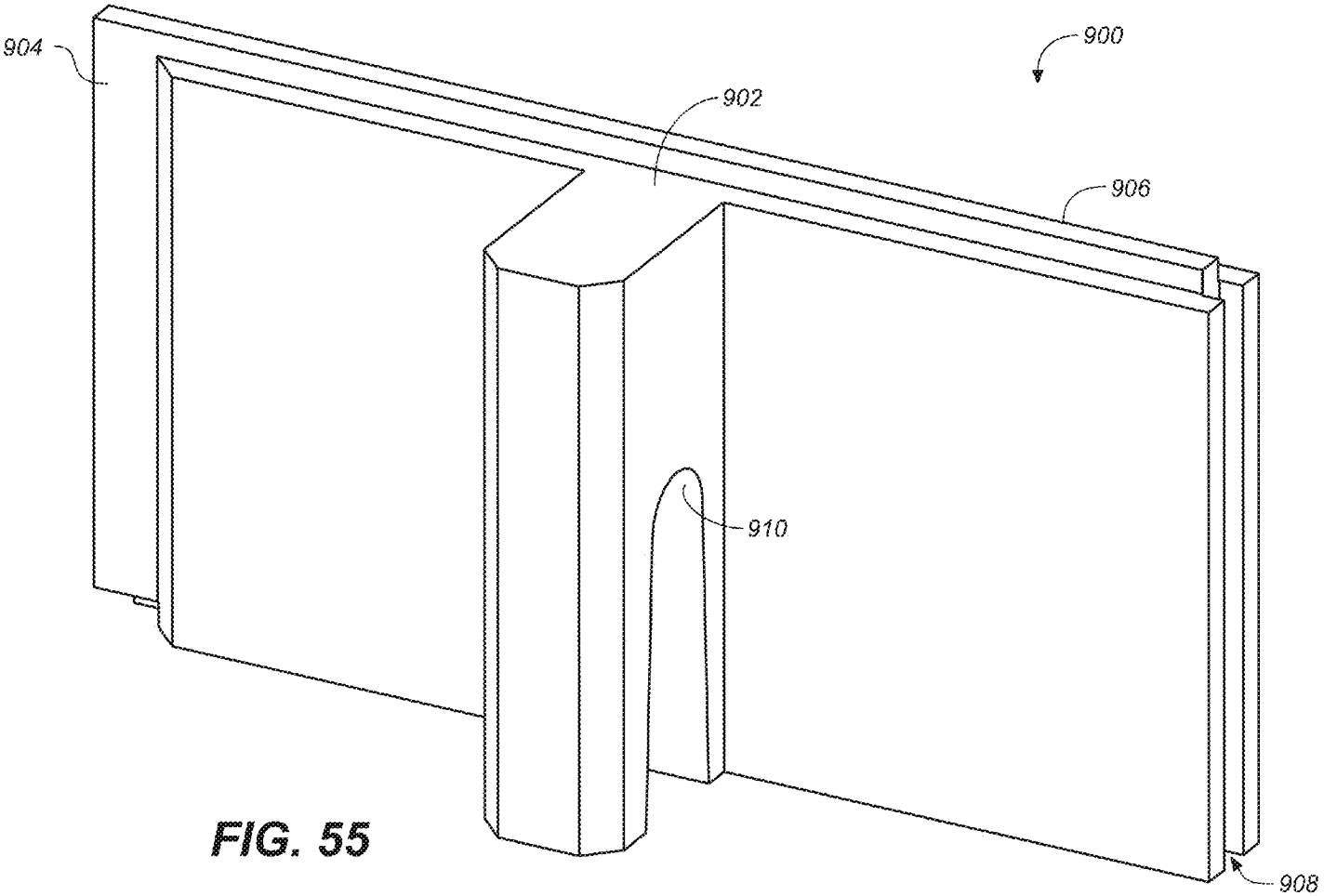
FIG. 55 is an upper rear perspective view of a thirteenth preferred embodiment of a wall unit of the present invention, a variation on the wall unit of FIG. 53, again comprising part of a bracket-assisted system.
Figure 56:
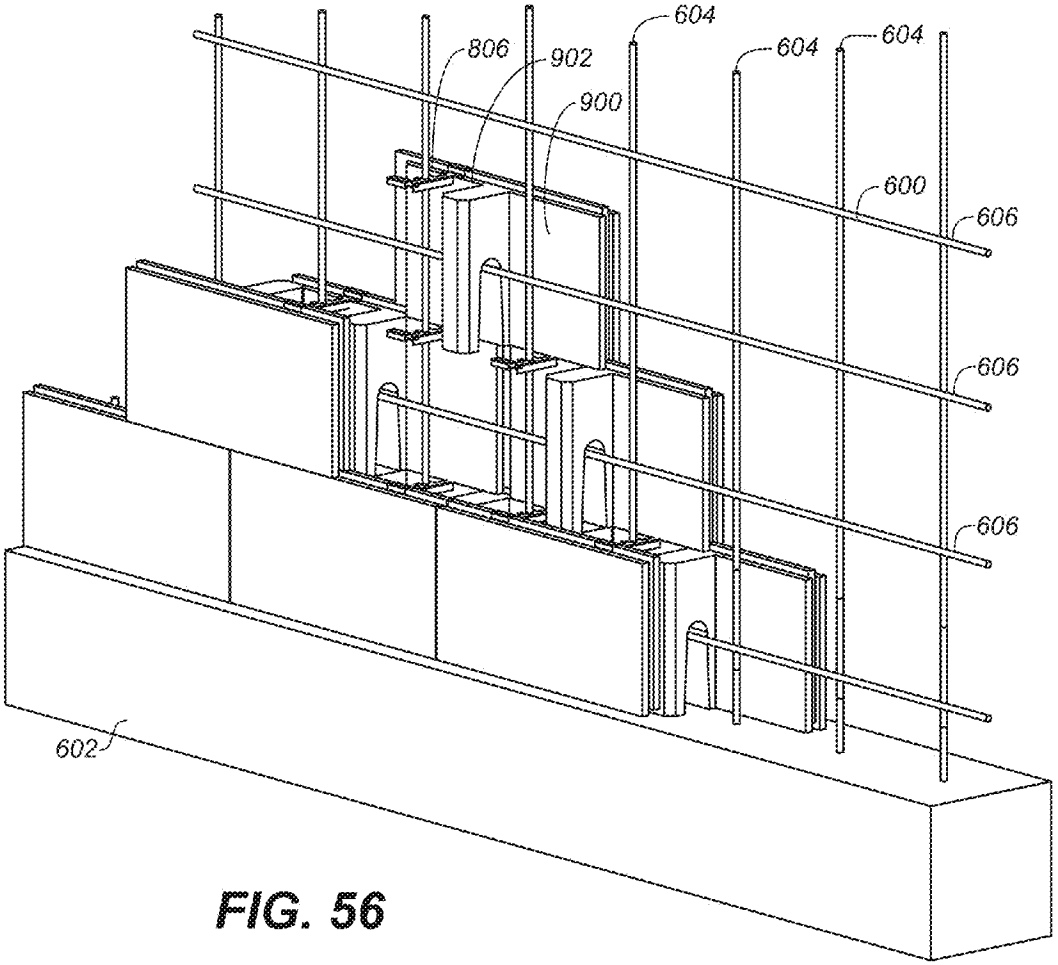
FIG. 56 is an upper rear (interior) side perspective view showing the wall unit of FIG. 55 and the bracket of FIG. 44 used to assemble a wall through and around a pre-existing structural steel grid matrix.

FIG. 55 shows a final, thirteenth preferred embodiment 900, of a wall unit of the present invention, this being a variation on the wall unit of FIG. 53. In this instance the male element 902 is positioned generally medially on the rear side of the wall unit, and the female recess 904 is proximate a side. The units are stagger stacked, as shown in FIG. 56, such that the male element fits snugly into the female recess, tongue and groove elements 906, 908 matingly connect with adjoining units, and the rounded arch 910 is disposed over a horizontal cross member 606 of the grid matrix 600. Rebar bracket 806 may be employed as a containment bracket.

The inventive cementitious wall units of the present invention are scalable to any size, and they are therefore designed for numerous uses, most notably for use in a wall system for constructing residential structural and commercial spaces, office building walls, and landscaping walls similar to those using the prior art CMU (concrete masonry unit) and ICF (insulated concrete form) systems described above, including systems made by Rasta Engineering Inc., of Scottsdale, Arizona; Trilogy Materials, Ltd; Apex Block of Winchester, Oregon; Nudura, Phil-Insul Corporation (Integraspec) of Kingston, Ontario, Canada; and Formetch of Stow, Ohio. The system comprises identical opposing wall units having either interlocking elements that cooperate with one another to lock and stack to form a permanent insulated (and/or structural) wall, or brackets for holding opposing panels in a spaced-apart opposing relationship to one another through and around the pre-existing grid matrix. The voids formed in the combination of wall unit elements are continuous and contiguous, such that when fully constructed the voids formed between opposing wall unit elements are in fluid communication with voids between adjoining pairs of opposing wall unit elements, thereby providing a network of a continuous void for containment of concrete, mortar, or other cementitious material may be poured to form a solid wall. The novel design allows for the prefabrication and unit placement of structural steel reinforcement bars, wires, or rods in the form of grid or matrix panels, and the subsequent placement of interlocking wall units using the pre-placed grid matrix. The interlocking connection is fail safe and requires no adhesive, mortared joints, or external shoring and bracing while the internal voids are filled with void fill material.

Accordingly, in its most essential aspect, the inventive wall construction system will be seen to comprise a system for rapidly assembling a two-sided wall on, through, and around a pre-installed structural steel grid, the preferred embodiments including a plurality of wall units, each having an outer side and an inner side, wherein the outer side functions as an outer wall finish surface after installation, and the inner side opposes an inner side of at least one other wall unit on an opposing side of the structural steel grid. Interlock elements are disposed between the opposing wall units, most of which (those within the spaces defined by the grid matrix), when installed, extend through a space in the structural steel grid and span from at least an inner side of one wall unit to another wall unit at the same course level so as to prevent separation of opposing wall units. When installed in courses around the structural steel grid, the wall units and interlock elements create a continuous void in the space between wall units placed on opposing sides of the structural steel grid. The voids between any two opposing wall units are in fluid communication with the voids between any all other wall units in the assembly. While not mandatory, structural void fill material can be poured or otherwise introduced into the continuous void at one or more places in the assembled wall (typically the top), and the void fill material will then be distributed to fill the continuous void from the top of the wall to the sides and bottom of the wall.

The foregoing description also sets out a simple method of rapidly assembling a twosided wall on, through, and around a pre-installed structural steel grid. The inventive method includes the steps of: (a) erecting a substantially planar structural steel grid in a generally vertical orientation, preferably embedded in or attached to a concrete footing; (b) providing a plurality of wall units, each having an outer side and an inner side; (c) installing a first wall unit on one side of the structural grid; (d) installing a second wall unit on the side of the structural grid opposite the side on which the first wall unit is installed so as to bring integral interlock elements (if any) of the wall units into an interlocking engagement with one another, or, alternatively placing cross-over interlocking brackets or connector units between the first and second wall units so as to prevent separation of the first wall unit from the second wall unit; (e) continuing step (d) until a first course of wall units has been installed, such that the inner side of each wall unit opposes an inner side of at least one other wall unit on an opposing side of the structural steel grid, and such that the outer side of each wall unit functions as an outer wall surface; (f) optionally shimming the first course as assembly proceeds to ensure that the first course is laid level; (g) continuing steps (c) through (e) so as to assemble a wall of at least one course of wall units, such that the assembled elements including the structural grid, the wall units, and the interlock elements create a continuous void in the space between wall units placed on opposing sides of the structural grid, wherein a majority of the interlock elements extend through a space defined by the horizontal and vertical members of the structural steel grid, wherein the voids between any two opposing wall units are in fluid communication with the voids between any all other wall units in the assembly, and such that structural fill material can optionally be poured into the continuous void at one or more places in the upper course of the assembled wall and will fill the continuous void from the top of the wall to the bottom of the wall.

A distinct advantage of every embodiment of the inventive system is that the wall units and interlocking elements or brackets when assembled form a cavity or space between the wall units and around the structural steel grid that makes it possible to install elements of various building systems, including electrical, plumbing and heating systems, on the structural steel grid before the wall is built.

Furthermore, the wall when assembled does not require glue or mortar in the joints before void fill material is poured into the assembled wall. In walls of sufficiently low profile, the wall does not require side support during fill operations.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. Indeed, it should be readily understood that the present invention is scalable both dimensionally and conceptually.

Therefore, the above description and illustrations should not be construed as limiting the scope of the invention

SEQUENCE LISTING

Not applicable.

What is claimed as invention is:

1. A system for rapidly assembling a two-sided wall through and around a pre-installed structural steel grid, comprising:

the structural grid including vertical and horizontal reinforcing members having a predetermined length and height, a first side, and an opposite side;

a plurality of wall units, each of said wall units having a planar first surface and a second surface configured with at least one extending, interlocking element;

wherein a first of said wall units is positioned with said second surface oriented to face the first side of the structural grid and said extending, interlocking element is disposed through a space between said vertical and horizontal reinforcing members, and a second of said wall units is positioned on said opposite side of the structural grid, said second wall unit is radially translated about an axis to bring said extending, interlocking element of said second wall unit into complete interlocking engagement with said extending, interlocking element of said first wall unit so as to prevent said first wall unit and said second wall unit from separating apart from the structural grid and from one another;

wherein said wall units are arranged in courses such that each set of said courses froms a facing so that said wall units in one facing in said first side are in back-to-back relation to said wall units in the opposed facing in said opposite side; and wherein said wall units are installed in said courses around and through the structural grid and said wall units cooperate with said interlocking element to create a continuous void in the space between wall units positioned on opposing sides of the structural grid, such that voids between any two opposing wall units are in fluid communication with the voids between any and all other wall units in the assembly, such that a fill material is poured into the continuous void at one or more places in the assembled wall and the void fill material substantially fills the continuous void.

2. The system of claim 1, wherein said wall units provide a finish surface on both sides of said two-sided wall.

3. The system of claim 1, wherein said wall units are fabricated from a material selected from the group consisting of lightweight concrete, structural concrete, cellular concrete, glass fiber reinforced concrete, cellulose fiber reinforced concrete, geo-polymer concrete, expanded polystyrene foam, recycled polystyrene foam, and polystyrene foam bead concrete.

4. The system of claim 1, wherein said wall units are fabricated from a thermally insulating material.

5. The system of claim 1, wherein said wall units are made of a composite of structural masonry and thermally insulating material.

6. The system of claim 1, wherein the fill material further includes structural fill material or thermally insulating fill material.

7. The system of claim 6, wherein said wall units are substantially identical and of a single unitary design, such that when assembled in courses in an opposing orientation on two sides of said structural grid with said interlocking elements extending through said structural grid, said interlocking elements of said wall units securely mate and interlock, thereby connecting opposing wall units so as to resist separation and enabling containment of said structural or thermally insulating fill material.

* * * * *